US009631381B2

(12) United States Patent
McLain

(10) Patent No.: US 9,631,381 B2
(45) **Date of Patent: *Apr. 25, 2017**

(54) SAFETY BAND LONGITUDINAL AND TRANSVERSE CONTROL

(71) Applicant: Michael J. McLain, Green Bay, WI (US)

(72) Inventor: Michael J. McLain, Green Bay, WI (US)

(73) Assignee: MATE, LLC, Green Bay, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/203,801

(22) Filed: Mar. 11, 2014

(65) Prior Publication Data

US 2015/0259935 A1 Sep. 17, 2015

(51) Int. Cl.

| | |
|---|---|
| ***E04G 21/32*** | (2006.01) |
| ***E04D 13/16*** | (2006.01) |
| ***E04B 7/02*** | (2006.01) |

(52) U.S. Cl.

CPC ..... *E04G 21/3266* (2013.01); *E04B 7/024* (2013.01); *E04D 13/1625* (2013.01); *Y10T 29/49874* (2015.01)

(58) Field of Classification Search

CPC combination set(s) only.

See application file for complete search history.

(56) References Cited

U.S. PATENT DOCUMENTS

| | | | | |
|---|---|---|---|---|
| 3,969,863 A * | 7/1976 | Alderman | ..... | E04D 3/3602 52/407.4 |
| 4,047,346 A * | 9/1977 | Alderman | ..... | E04D 15/06 52/127.5 |
| 4,446,664 A | 5/1984 | Harkins | | |
| 4,573,298 A | 3/1986 | Harkins | | |
| 4,875,320 A | 10/1989 | Sparkes | | |

(Continued)

FOREIGN PATENT DOCUMENTS

WO 2012145783 11/2012

OTHER PUBLICATIONS

Guardian Energy Saver FP, printed from internet Aug. 4, 2014, 23 pages.

(Continued)

*Primary Examiner* — Robert Canfield

(74) *Attorney, Agent, or Firm* — Thomas D. Wilhelm; Northwind IP Law, S.C.

(57) ABSTRACT

This invention provides fall protection systems comprising a suspension fabric, supported by a grid-work of longitudinal and lateral bands, in metal building construction. The fall protection system uses safety clips to attach lateral bands to intermediate purlins, and also provides novel attachments of the lateral bands to eaves and ridges whereby the respective eave and/or the ridge absorbs an enhanced portion of the force of impact when an object falls onto the fall protection system. The invention further provides methods of installing such systems, and buildings embodying such systems.

29 Claims, 13 Drawing Sheets

(56) References Cited

U.S. PATENT DOCUMENTS

| | | | | |
|---|---|---|---|---|
| 5,201,152 | A | 4/1993 | Heffner | |
| 5,251,415 | A | 10/1993 | Van Auken et al. | |
| 5,406,764 | A | 4/1995 | Van Auken et al. | |
| 5,901,518 | A | 5/1999 | Harkins | |
| 5,953,875 | A | 9/1999 | Harkins | |
| 6,094,883 | A * | 8/2000 | Atkins | E04D 12/002 156/71 |
| 6,226,945 | B1 | 5/2001 | Henry et al. | |
| 6,247,277 | B1 | 6/2001 | Kerpash, Sr. | |
| 6,401,426 | B1 | 6/2002 | Alderman et al. | |
| 6,748,715 | B1 | 6/2004 | Black et al. | |
| 8,590,245 | B2 | 11/2013 | Peng et al. | |
| 2002/0020584 | A1 | 2/2002 | Cjepa | |
| 2003/0114055 | A1 | 6/2003 | Burton et al. | |
| 2011/0067345 | A1 | 3/2011 | Crostic, Jr. et al. | |
| 2012/0174502 | A1 * | 7/2012 | Oberg | E04D 13/1618 52/173.1 |
| 2013/0108377 | A1 | 5/2013 | Steffenino | |
| 2013/0305623 | A1 * | 11/2013 | Pendley | E04G 21/3266 52/27 |

OTHER PUBLICATIONS

Guardian Energy Saver FP, Roof System Installation Instructions, 2009, 4 pages Guardian Building Products Distribution, Inc., Solon, Ohio.

Silvercote Lamination, ES Energy Saver FP, brochure, Copyright 2014, 20 pages, Silvercote Laminations, Greer, South Carolina.

Guardian Building Products Distribution, Inc., Guardian ES Energy Saver FP, Product Specification Sheet, Copyright 2011, 2 pages, Guardian Building Products, Greer, South Carolina.

Harris Steel, Industry properties for Steel Sheets—Cold Rolled & Hot Dipped Zinc Coated, Specification Sheet, 2 pages, Harris Steel.

Steelscape, A Bluescope Steel Company, Zincalume Steel Grade 50 (Class 1), Grade Data Sheet, Jul. 1, 2012, 1 page, Steelscape.

Steelscape, A Bluescope Steel Company, Zincalume Steel Grade 80 (Class 1), Grade Data Sheet, Jul. 1, 2012, 1 page, Steelscape.

Maple Leaf Sales, K-Grip 514 Flammable Foam, Product Data Sheet, 1 page.

Maple Leaf Sales II, Inc., 514 Macroplast Adhesive, Material Safety Data Sheet, dated Jul. 16, 2010, 3 pages.

* cited by examiner

SAFETY BAND LONGITUDINAL AND TRANSVERSE CONTROL

BACKGROUND OF THE INVENTION

This invention relates to buildings, building components, building subassemblies, and building assemblies, and to methods of constructing buildings. This invention relates specifically to components, subassemblies, and to assemblies, as parts of the building, and to the issue of worker safety during the construction of buildings.

From time to time, injuries occur during construction of buildings, including to workers who fall from elevated heights. The focus of this invention is to enable a building contractor to reduce, desirably to eliminate, the number of incidents of worker injuries resulting from workers falling from elevated heights while working on construction of the building.

Governmental safety organizations, for example the Occupational Safety and Health Administration (OSHA) in the US, have promulgated required safety standards, and safety practices to generally provide safety systems which capture and support workers who are working at substantial heights above supporting surfaces, to protect such workers, namely to stop a fall, and to support such workers if/when such workers fall. But it is up to the industry to create fall protection systems which meet the required standards.

With pre-engineered building systems the predominant method of non-residential low rise construction for buildings, existing fall protection standards have substantial impact on the contractors involved.

One way a worker can be protected, according to the standards, is for the worker to wear a safety harness which is tied, by a strap, to the building structure such that the harness/strap combination stops any fall which the worker experiences before the worker encounters an underlying surface such as a floor or the ground. Use of such safety harness is known as "tying off". But tying the harness to the building limits the workers range of movement. Thus tie-off harnesses are not viewed favorably in the industry.

Another way the workers can be protected is for the building contractor to erect heavy and expensive safety nets in order to provide leading edge protection against falls. Cost and maintenance of such nets and associated equipment, the expense of erecting and dismantling such nets and associated equipment, and moving and storing such nets and equipment, can be a substantial increment in the per square foot cost of especially the roof insulation system being installed.

With the anticipation of expanded enforcement efforts by OSHA, building erectors have increased incentive to find ways to meet the existing fall protection requirements.

Another acceptable fall protection system is a passive system wherein a fabric, such as a solid sheet, a woven sheet, or a net-like material, is suspended at or below the work area, optionally supported by a grid of crossing support bands, far enough above any underlying supporting surface to catch and support a worker who falls, thereby to act as a passive fall-protection system.

OSHA has defined a drop test procedure whereby a such passive fall protection system can be tested. According to the test procedure, a 400 pound weight is dropped onto the fall protection system under stated conditions to determine whether a given system meets the required safety standards. For purposes of complying with government regulations, any system used as a fall protection system need only meet the OSHA-mandated standards related to dropping such 400 pound weight. Of course, the real humanitarian objective is to prevent worker injuries if/when a worker falls from an elevated work location. Thus, any fall protection system which is effective to catch and safely hold a falling worker has operational value, even if such system does not meet OSHA standards.

According to one aspect of the prior art, currently in use in the metal building industry, and intended to meet government fall protection standards, a purported fall protection system uses crossing longitudinal and lateral metal bands extending under the eave, under the ridge, and under the intermediate purlins, and a fabric is installed above the bands and under the purlins, extending across the entirety of a respective bay of the building being constructed, thereby providing a suspended fabric intended to catch and support a falling worker in that bay. Insulation is ultimately installed on the top surface of the fabric whereby the fabric ultimately functions as the vapor barrier portion of the building ceiling insulation system in the finished building.

Testing has shown that currently-available such systems meet the government-mandated drop test standard at certain locations in the bay of a metal building under construction, while failing such drop test at other locations. Typically, such systems fail the drop test adjacent an edge of the bay, where any worker accidental fall is most likely to occur. Thus, the user cannot be assured that a falling worker will be caught and supported at whatever location he/she falls from at the elevated work location. Such failure can result in worker injury, along with the numerous detrimental results of such injury, as well as resulting government citations associated with the resulting injury, and associated monetary fines and/or assessments, civil lawsuits, and the like.

Accordingly, there is a need for a novel passive fall protection system for use during construction of metal buildings which effectively catches and supports a falling worker working at an elevated height, and which system meets all governmental safety standards.

There is also a need to provide a portion of a building insulation system which functions to provide effective fall protection during construction of the building, while meeting the existing governmental fall protection requirements.

There is further a need for methods of mounting fall protection systems to building structural members during construction of metal buildings, fall protection systems which effectively catches and support a falling worker working at an elevated height, and which systems meet all governmental safety standards.

These and other needs are alleviated, or at least attenuated, or partially or completely satisfied, by novel products, systems, and methods of the invention.

SUMMARY OF THE INVENTION

This invention provides fall protection systems comprising a suspension fabric, supported by a grid-work of longitudinal and lateral bands, in metal building construction. The fall protection system uses safety clips to attach lateral bands to intermediate purlins such that the respective lateral bands are attached to less than all, or none, of the intermediate purlins, whereby the relatively longer unfastened lengths of the lateral bands, at critical locations in the fall protection system, enables the system to distribute the force/shock of a load dropping onto the system over relatively longer lengths of the respective lateral bands, and to the eave and ridge as well as to the intermediate purlins, thus reducing the magnitude of a remainder portion of the shock/force of the fallen load which must be absorbed by the fabric. The fall protection system of the invention also provides novel attachments of the lateral bands to eaves and ridges whereby the respective eave and/or the ridge absorbs an enhanced portion of the force of impact, when an object falls onto the fall protection system, before that force reaches mechanical fasteners or other attachment mechanism, which is used to fasten the fabric to the ridge and/or eave. The invention further provides methods of installing such systems, and buildings embodying such systems.

In a first family of embodiments, the invention comprehends, in a building roof structure, building structural roof elements which include at least first and second rafters, a space between the first and second rafters defining a first distance between the first and second rafters, each rafter having a top, and opposing first and second ends, the roof structure further comprising an eave, having a length, and extending between the first ends of the first and second rafters, a ridge, having a length, and extending between the second ends of the first and second rafters, and a second distance between the eave and the ridge, the eave and the ridge being disposed on, extending transverse to, and being connected to, the tops of the first and second rafters, and a plurality of intermediate purlins extending between the first and second rafters and spaced from each other between the eave and the ridge, the intermediate purlins being disposed on, and extending transverse to, the tops of the first and second rafters. A fall protection system is installed at the roof structure, for protecting workers involved in installation of the roof structure. The fall protection system comprises a first set of support bands extending from the first rafter to the second rafter and is connected to the building structural roof elements, the first set of support bands being spaced along the lengths of the first and second rafters a second set of support bands extending from the eave toward the ridge and under the intermediate purlins, the second set of support bands having first and second end portions and being spaced along the lengths of the eave and the ridge; and a suspension fabric overlying, and being supported by, the first and second sets of support bands, the suspension fabric being wider than the distance between the first and second rafters and longer than the distance between the eave and the ridge, a first band of the second set of support bands being attached to the building roof structure, for restraint of longitudinal movement of the band at less than all of the first and second end portions and the intermediate purlins. The fall protection system, as installed is, optionally, of sufficient strength to catch and support a weight of 400 pounds, distributed over a diameter of approximately 30 inches, when dropped from a height of about 50.5 inches.

In some embodiments, the first band is attached to the building roof structure, for restraint of longitudinal movement, at locations spaced from each other by at least 10 feet, optionally at least 15 feet, further optionally at least 20 feet, still further optionally at least 25 feet.

In some embodiments, the first band is attached to the building roof structure only at the first and second end portions.

In some embodiments, a purlin has a top flange, a bottom flange, and a web extending between the top flange and the bottom flange, and wherein the first band is held proximate the bottom flange of the respective purlin.

In some embodiments, a such purlin has a top flange, a bottom flange, and a web extending between the top flange and the bottom flange, the first band, when in a generally horizontally-extending orientation, having a generally horizontally-extending length, a generally horizontally-extending width, and a generally vertically-extending thickness, a safety clip being attached to one of the intermediate purlins, the safety clip comprising a loop held proximate the bottom flange of the respective purlin, the loop at least in part defining an opening through the safety clip, the loop receiving the first band through the opening in such generally-horizontally-extending band orientation, and confining the first band in such loop proximate the respective intermediate purlin and relative to lateral movement while accommodating generally unrestricted longitudinal movement of the first band relative to the loop.

In some embodiments, the first and second rafters underlie and support the first set of bands.

In some embodiments, the purlins have top flanges and bottom flanges, and webs extending between the top flanges and the bottom flanges, and the second set of support bands underlies the first set of support bands and wherein, at locations where a support band of the second set underlies and supports a support band of the first set, the band of the second set holds the band of the first set at an elevation which approximates an elevation of the bottom flange of an adjacent intermediate purlin.

In some embodiments, the eave has a top flange having a first remote edge remote from the ridge and a first distal edge relatively closer to the ridge, a bottom flange having a second remote edge remote from the ridge and a second distal edge relatively closer to the ridge, and an eave web extending between the top flange and the bottom flange, and wherein the first band extends under the bottom flange of the eave, optionally trapping the suspension fabric between the lateral band and the bottom flange of the eave, and the first band turns a first corner about the second remote edge of the bottom flange and extends upwardly from the bottom flange alongside the web to the top flange, turns a second corner about the first remote edge of the top flange, and extends, as the first end portion of the first band, toward the ridge, the first end portion of the first band being attached by an attachment means to a roof structural element between the second corner and a remote end of the first band, and wherein the turning of the first band about the first and second corners preferentially transfers a substantial portion of any tensile force, imposed on the first band between said eave and said ridge, directly to the eave rather than to the attachment means and through the attachment means to the eave.

In some embodiments, the eave further comprises a top flange return extending down from the distal edge of the top flange, and the first band turns a third corner about the first distal edge of the top flange, and is fastened to the top flange return.

In some embodiments, the suspension fabric extends, as a generally flat sheet, across an open expanse bounded by the first rafter, the ridge, the second rafter, and the eave, the suspension fabric being supported by the first and second sets of bands and being restrained against movement along the structural roof elements by attachments of the suspension fabric to the first and second rafters, to the eave at a first end of the suspension fabric and to another one of the structural roof elements at a second opposing end of the suspension fabric.

In a second family of embodiments, the invention comprehends, in a building roof structure, building structural roof elements including at least first and second rafters, spaced from each other by a first distance between the first and second rafters, each rafter having an upper surface, and opposing first and second ends, the roof structure further comprising an eave, having a length, and extending between the first ends of the first and second rafters, a ridge, having a length, and extending between the second ends of the first and second rafters, and a second distance between the eave and the ridge, the eave and the ridge being disposed on, extending transverse to, and being connected to, the tops of the first and second rafters, and a plurality of intermediate purlins extending between the first and second rafters and spaced from each other between the eave and the ridge, the intermediate purlins being disposed on, and extending transverse to, the tops of the first and second rafters. A fall protection system, installed at the roof structure, for protecting workers involved in installation of the roof structure, comprises a first set of support bands extending from the first rafter to the second rafter and connected to the building structural roof elements, the first set of support bands being spaced along the lengths of the first and second rafters; a second set of support bands extending from the eave toward the ridge and under the intermediate purlins, the second set of support bands having first and second end portions and being spaced along the lengths of the eave and the ridge; and a suspension fabric overlying, and being supported by, the first and second sets of support bands, the suspension fabric being wider than the distance between the first and second rafters and longer than the distance between the eave and the ridge, a first band of the second set of support bands having a generally horizontally-extending length, a generally horizontally-extending width, and a generally vertically-extending thickness, a safety clip being attached to one of the intermediate purlins, the safety clip comprising a loop at least in part defining an opening through the safety clip, wherein the loop receives the first band through the opening in the generally-horizontally-extending orientation of the first band, and restricts the first band in the loop relative to lateral movement while accommodating generally unrestricted longitudinal movement of the first band relative to the loop.

In some embodiments, the eave has a top flange having a first remote edge remote from the ridge and a first distal edge relatively closer to the ridge, a bottom flange having a second remote edge remote from the ridge and a second distal edge relatively closer to the ridge, and a web extending between the top flange and the bottom flange, and wherein the first band extends under, and contacts, the bottom flange of the eave, turns a first corner about the second remote edge of the bottom flange and extends upwardly from the bottom flange alongside the web to the top flange, turns a second corner about the first remote edge of the top flange, and extends, as the first end portion of the first band, toward the ridge, the first end portion of the first band being attached by an attachment means to a roof structural element between the second corner and a remote end of the first band, and wherein the turning of the first band about the first and second corners preferentially transfers a substantial portion of any tensile force, imposed on the first band between the eave and the ridge, directly to the eave rather than to the attachment means and through the attachment means to the eave.

In some embodiments, the first band turns a third corner about the first distal edge of the top flange and is attached to the eave between the third corner and the remote end of the first band.

In a third family of embodiments, the invention comprehends, in a building roof structure, building structural roof elements including at least first and second rafters, spaced from each other by a first distance between the first and second rafters, each rafter having an upper surface, and opposing first and second ends, the roof structure further comprising an eave, having a length, and extending between the first ends of the first and second rafters, a ridge, having a length, and extending between the second ends of the first and second rafters, and a second distance between the eave and the ridge, the eave and the ridge being disposed on, extending transverse to, and being connected to, the tops of the first and second rafters, and a plurality of intermediate purlins extending between the first and second rafters and spaced from each other between the eave and the ridge, the intermediate purlins being disposed on, and extending transverse to, the tops of the first and second rafters. A fall protection system, installed at the roof structure, for protecting workers involved in installation of the roof structure comprises a first set of support bands extending from the first rafter to the second rafter and being connected to the building structural roof elements, the first set of support bands being spaced along the lengths of the first and second rafters; a second set of support bands extending from the eave toward the ridge and under the intermediate purlins, the second set of support bands having first and second end portions and being spaced along the lengths of the eave and the ridge; and a suspension fabric overlying, and being supported by, the first and second sets of support bands, and being attached to the building structural roof elements, the eave having a top flange having a first remote edge remote from the ridge and a first distal edge relatively closer to the ridge, a bottom flange having a second remote edge remote from the ridge and a second distal edge relatively closer to the ridge, and a web extending between the top flange and the bottom flange, and wherein the first band extends under the bottom flange of the eave, optionally trapping the suspension fabric between the lateral band and the bottom flange of the eave, and the first band turns a first corner about the second remote edge of the bottom flange and extends upwardly from the bottom flange alongside the web to the top flange, turns a second corner about the first remote edge of the top flange, and extends, as the first end portion of the first band, toward the ridge, the first end portion of the first band being attached by an attachment means to a roof structural element between the second corner and a remote end of the first band, and wherein the turning of the first band about the first and second corners preferentially transfers a substantial portion of any tensile force, imposed on the first band between the eave and the ridge, directly to the eave rather than to the attachment means and through the attachment means to the eave.

In some embodiments, the eave further comprises a top flange return extending down from the distal edge of the top flange, and the first band turns a third corner about the first distal edge of the top flange, extends downwardly along the top flange return, and is fastened to the top flange return.

In some embodiments, the first band is attached to the building roof structure, for restraint of longitudinal movement, at locations spaced from each other by at least 10 feet, optionally at least 20 feet.

In some embodiments, the first band is attached to the building roof structure only at the first and second end portions.

In some embodiments, the purlins have top flanges and bottom flanges, and webs extending between the top flanges and the bottom flanges, and the second set of support bands underlies the first set of support bands and, at locations where a support band of the second set underlies and supports a support band of the first set, the band of the second set holds the band of the first set at an elevation which approximates an elevation of the bottom flange of an adjacent intermediate purlin.

In a fourth family of embodiments, the invention comprehends, in a building roof structure, building structural roof elements including at least first and second rafters, spaced from each other by a first distance between the first and second rafters, each rafter having an upper surface, and opposing first and second ends, the roof structure further comprising an eave, having a length, and extending between the first ends of the first and second rafters, the eave having a top flange having a first remote edge relatively remote from the ridge and a first distal edge relatively closer to the ridge, a bottom flange having a second remote edge relatively remote from the ridge and a second distal edge relatively closer to the ridge, and an eave web extending between the top flange and the bottom flange, the building structural roof elements further comprising a ridge, having a length, and extending between the second ends of the first and second rafters, and a second distance between the eave and the ridge, the eave and the ridge being disposed on, extending transverse to, and being connected to, the tops of the first and second rafters, and a plurality of intermediate purlins extending between the first and second rafters and spaced from each other between the eave and the ridge, the intermediate purlins being disposed on, and extending transverse to, the tops of the first and second rafters, the building roof structure including a fall protection system for protecting workers involved in installation of such roof structure. The fall protection system comprises a first set of support bands extending from the first rafter to the second rafter and connecting the first set of support bands to the building structural roof elements, the first set of support bands being spaced along the lengths of the first and second rafters, a second set of support bands extending from the eave toward the ridge and under the intermediate purlins, the second set of support bands being spaced along the lengths of the eave and the ridge, and a suspension fabric overlying the first and second sets of support bands such that the suspension fabric is supported by the first and second sets of support bands, the suspension fabric being attached to the structural roof elements, the invention comprising a method of mounting an end portion of a first band, of the second set of bands, to the eave, the method comprising extending the first band under the bottom flange of the eave, optionally trapping the suspension fabric between the lateral band and the bottom flange of the eave, and turning the first band about a first corner at the second remote edge of the bottom flange and extending the first band upwardly from the bottom flange alongside the web to the top flange, turning the first band about a second corner at the first remote edge of the top flange so as to extend the first end portion of the first band toward the ridge, and attaching the first end portion of the first band, by an attachment means, to a such roof structural element between the second corner and a remote end of the first band.

In some embodiments, the eave further comprises a top flange return extending down from the distal edge of the top flange, the method further comprising turning the first band about a third corner at the first distal edge of the top flange so as to extend the first end portion of the first band downwardly from the third corner along the top flange return, and fastening the first end portion of the first band to the top flange return.

In some embodiments, the method further comprises attaching the first band to the building roof structure, for restraint of longitudinal movement of the first band, at locations spaced from each other by at least 10 feet, optionally at least 20 feet.

In some embodiments, the method further comprises the first band having first and second end portions, and attaching the first band to the building roof structure only at the first and second end portions.

In some embodiments, a such purlin has a top flange, a bottom flange, and a web extending between the top flange and the bottom flange, the first band, when in a generally horizontally-extending orientation, having a generally horizontally-extending length, a generally horizontally-extending width, and a generally vertically-extending thickness, the method further comprising attaching a safety clip to one of the intermediate purlins, the safety clip comprising a loop held proximate the bottom flange of the respective purlin, the loop at least in part defining an opening through the safety clip, and extending the first band through the opening such that the band is attached to the building roof structure by the safety clip and is confined in the loop proximate the respective intermediate purlin, against lateral movement, while providing generally unrestricted longitudinal movement of the first band relative to the loop.

In a fifth family of embodiments, the invention comprehends, in a building roof structure, building structural roof elements including at least first and second rafters, spaced from each other by a first distance between the first and second rafters, and roof insulation, each rafter having an upper surface, and opposing first and second ends, the roof structure further comprising an eave, having a length, and extending between the first ends of the first and second rafters, the building structural roof elements further comprising a ridge, having a length, and extending between the second ends of the first and second rafters, and a second distance between the eave and the ridge, the eave and the ridge being disposed on, extending transverse to, and being connected to, the tops of the first and second rafters, and a plurality of intermediate purlins extending between the first and second rafters and spaced from each other between the eave and the ridge, the intermediate purlins being disposed on, and extending transverse to, the tops of the first and second rafters, the building roof structure including a fall protection system for protecting workers involved in installation of such roof structure, the fall protection system comprising a first set of support bands extending from the first rafter to the second rafter and connecting the first set of support bands to the building structural roof elements, the first set of support bands being spaced along the lengths of the first and second rafters, a second set of support bands extending from the eave toward the ridge and under the intermediate purlins, the second set of support bands being spaced along the lengths of the eave and the ridge, a suspension fabric overlying the first and second sets of support bands such that the suspension fabric is supported by the first and second sets of support bands, the suspension fabric being attached to the structural roof elements, a given one of the purlins having a top flange, a bottom flange, and a web extending between the top flange and the bottom flange, a first band of the second set of support bands, when in a generally horizontally-extending orientation, having a generally horizontally-extending length, a generally horizontally-extending width, and a generally vertically-extending band thickness, a method of mounting the first band to a given one of the intermediate purlins, the method comprising attaching a safety clip to one of the intermediate purlins, the safety clip comprising a loop held proximate the bottom flange of the respective purlin, the loop at least in part defining an opening through the safety dip extending through the safety clip; and extending the first band through the opening such that the first band is attached to the building roof structure by the safety dip and is confined in the loop proximate the respective intermediate purlin, against lateral movement, while experiencing generally unrestricted longitudinal movement relative to such loop.

In some embodiments, the eave has a top flange having a first remote edge relatively remote from the ridge and a first distal edge relatively closer to the ridge, a bottom flange having a second remote edge relatively remote from the ridge and a second distal edge relatively closer to the ridge, and a web extending between the top flange and the bottom flange, the method further comprising mounting an end portion of the first band, of the second set of bands, to the eave, including extending the first band under the bottom flange of the eave, optionally trapping the suspension fabric between the lateral band and the bottom flange of the eave, and turning the first band about a first corner at the second remote edge of the bottom flange and extending the first band upwardly from the bottom flange alongside the web to the top flange, turning the first band about a second corner at the first remote edge of the top flange so as to extend the first end portion of the first band toward the ridge, and attaching the first end portion of the first band, by an attachment means, to a the roof structural element between the second corner and a remote end of the first band, the turning of the first band about the first and second corners preferentially transferring a substantial portion of any tensile force, imposed on the first band between the eave and the ridge, directly to the eave rather than to the attachment means and through the attachment means to the eave.

In some embodiments, the eave further comprises a top flange return extending down from the distal edge of the top flange, the method further comprising turning the first band about a third corner at the first distal edge of the top flange so as to extend the first end portion of the first band downwardly from the third corner, and fastening the first end portion of the first band to the top flange return.

In some embodiments, the first band is attached to the building roof structure, for restraint of longitudinal movement, at locations spaced from each other by at least 10 feet, optionally at least 20 feet.

BRIEF DESCRIPTION OF THE DRAWINGS

Illustrative embodiments of the invention are described hereinafter, by way of examples only, with reference to the accompanying drawings.

Figure 1:
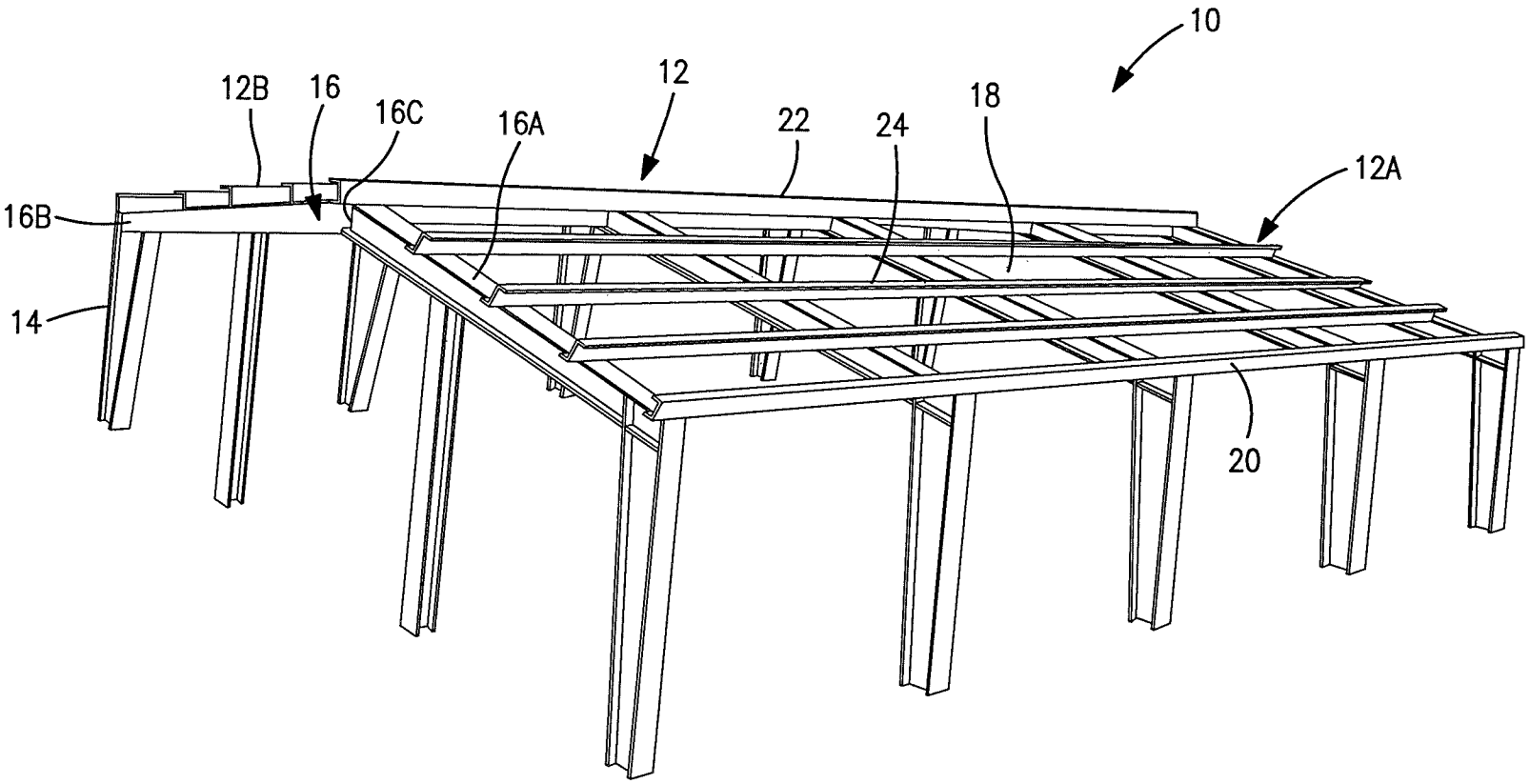
FIG. 1 PRIOR ART
FIG. 1 shows a perspective view, from above the eaves, of a typical metal building structure, including columns, rafters, eaves, ridges, and intermediate purlins.

The invention is not limited in its application to the details of construction, or to the arrangement of the components, or to the methods of construction, set forth in the following description or illustrated in the drawings. The invention is capable of other embodiments or of being practiced or carried out in various other ways. Also, it is to be understood that the terminology and phraseology employed herein is for purpose of description and illustration and should not be regarded as limiting. Like reference numerals are used to indicate like components.

DETAILED DESCRIPTION OF THE ILLUSTRATED EMBODIMENTS

FIG. 1 illustrates the primary structural members of a typical metal building 10 having first and second roof slopes 12A and 12B. Vertical support for the structural elements of the roof, designated generally as 12, is provided by upstanding columns 14 positioned along side walls and end walls of the building. Rafters 16 overlie the tops of the columns and are supported by the columns. Rafters 16 span the width of the building, creating a series of open spaces between rafters 16, the open spaces being commonly referred to as "bays" 18 in the construction arts, the bays representing distances between respective ones of the rafters. Each rafter has an upper surface 16A, and opposing first 16B and second 16C ends.

According to the embodiments illustrated in FIGS. 1-4, eaves 20, expressing "C"-shaped cross-sections, are positioned at the down-slope ends of the rafters 16, and lengths of the eaves extend along the length of the building, above the outer wall of the building, and provide lateral support to the skeletal structure of the building between respective ones of the columns 14, at the outer building wall. A given eave extends between the first ends 16B of respective ones of the rafters.

Figure 4:
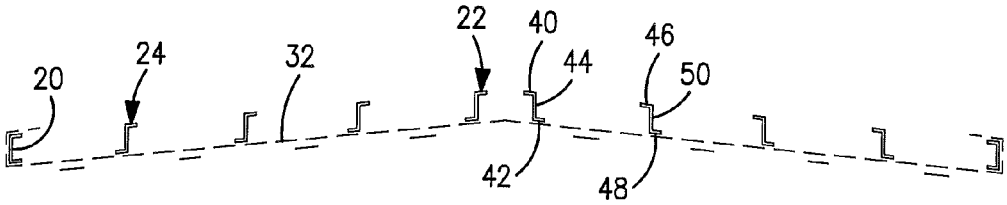
FIG. 4 is a diagrammatic end view of a roof structure of a metal building, showing longitudinal band spacing with respect to the eaves, the ridge, and the intermediate purlins.

Ridge members 22, expressing "Z"-shaped cross-sections as illustrated in FIG. 4, have lengths which overlie, and are attached to, the upper surfaces of rafters 16. The ridge members are positioned at the up-slope ends of the rafters, and run the length of the building parallel to the eaves, typically above the central portion of the building. The ridge members provide lateral support to the skeletal structure of the building between respective ones of rafters 16, typically at an internal portion of the building, away from the building side walls in the illustrated embodiments. A given ridge member extends between the second ends 16C of the respective ones of the rafters. Where the roof has a single pitch direction, the ridge can be positioned proximate one of the outer walls of the building.

The ridge members and the eave members overlie, extend transverse to, and are attached to, the upper surfaces of the respective rafters 16, and are spaced from each other by distances which generally correspond to the lengths of the respective rafters.

Intermediate purlins 24 express "Z"-shaped cross-sections. The intermediate purlins overlie, extend transverse to, and are attached to, upper surfaces 16A of the respective rafters. Purlins 24 are spaced from each other along the lengths of the rafters. The purlins extend parallel to each other and parallel to any ridges and eaves and, overall, span the length of the bay, whereby the purlins are displaced from each other and from any ridges and eaves along the spaces between the respective eave and the ridge.

Figure 2:
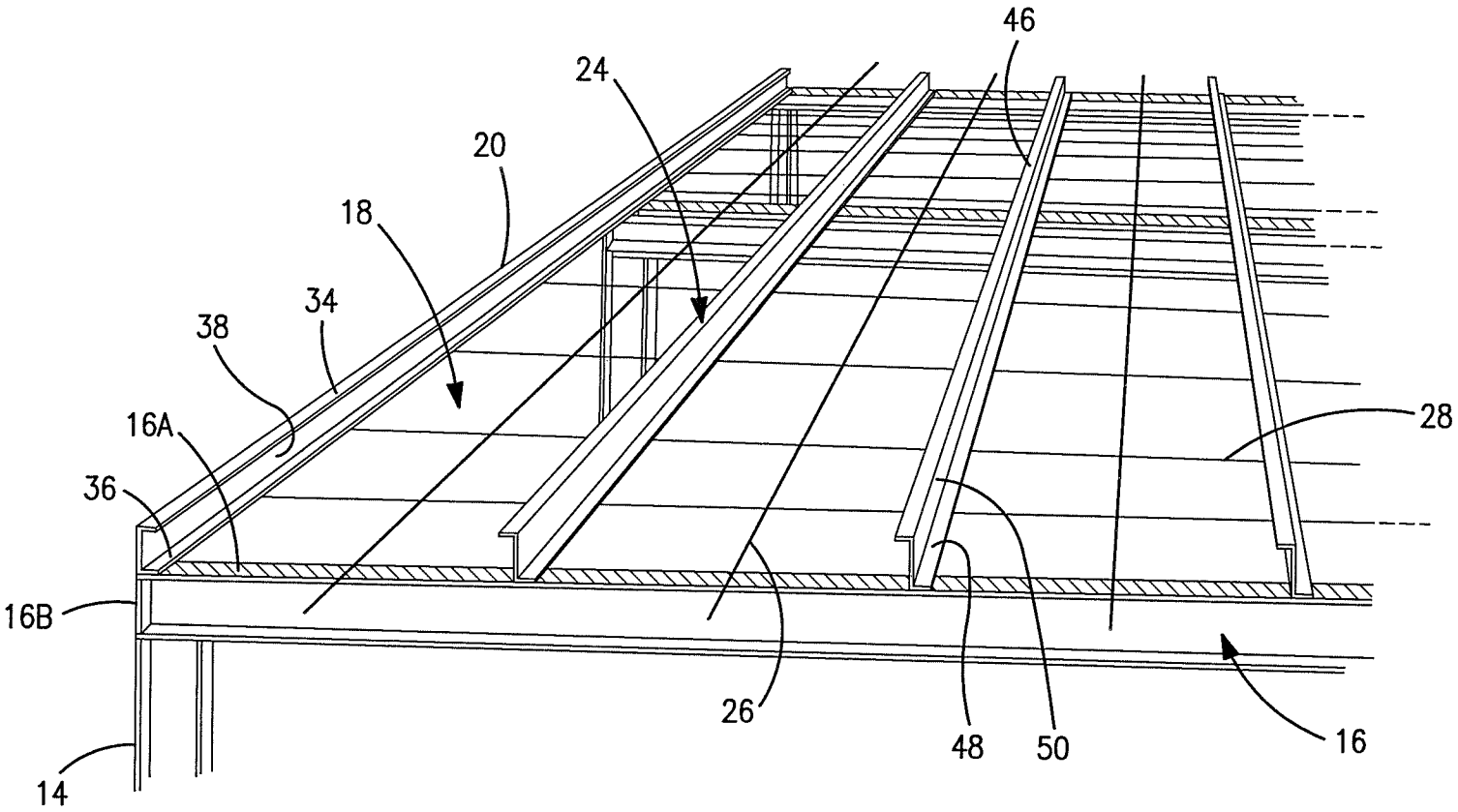
FIG. 2 is a perspective view, from above the roof, of part of a bay of a metal building, showing columns, rafters, purlins, an eave, and a grid-work of crossing bands.

As shown in FIG. 2, the fall protection support system, namely the suspension system, of this invention includes a supporting grid-work formed by crossing elongate steel bands, including longitudinal support bands 26 and lateral support bands 28. Support bands 26, 28 of the grid-work are supported by various ones of the building structural members, as described herein, and the collective grid-work generally defines an imaginary plane, extending into the sheet of the drawing illustrated FIG. 4. Such imaginary plane extends parallel to a set of imaginary straight lines, spaced from each other and extending between the lower surfaces of the eaves 20, the ridge 22, and intermediate purlins 24, and further extending parallel to imaginary straight lines which connect the upper surfaces of the rafters.

Figure 3:
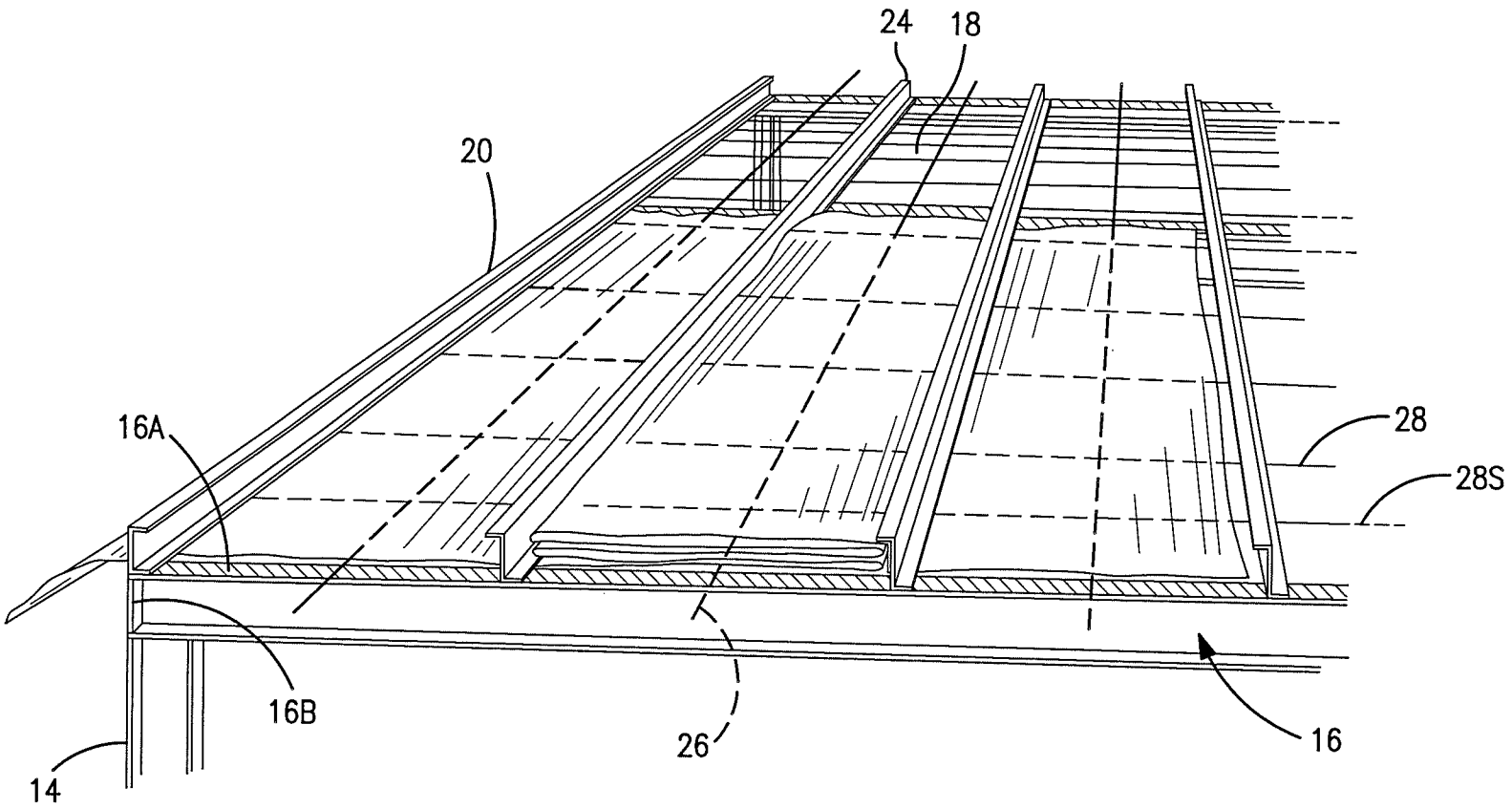
FIG. 3 is a perspective view as in FIG. 2 showing a suspension fabric partially extended over the band grid-work and under the eave and under the purlins, in a single bay.

Support bands 26, 28 support a high strength fabric 32, the fabric being shown partially unfolded in FIG. 3 and, in FIG. 4, the fabric is suggested by the dashed line under the eave, ridge, and intermediate purlins, and above longitudinal bands 26, bands 26 being shown in FIG. 4 in end view. Fabric 32 in the illustrated embodiments also serves as a vapor barrier for the insulation system which is ultimately installed at the roof of the building.

Starting with the structural skeleton of the building as illustrated in FIG. 1, a fall protection system of the invention is installed generally as follows. Longitudinal metal bands 26 are extended from the upper surface of a first one of the rafters to the upper surface of a second one of the rafters at angles which are typically, but not necessarily, perpendicular to the respective rafters. The number of longitudinal bands 26 depends to some degree on the distance between the respective ones of the intermediate purlins 24. In the invention, typically only a single longitudinal band 26 is used between each pair of next-adjacent purlins 24. However, in certain systems, which can be engineered based on the technology disclosed herein, two or more longitudinal bands may be used where such additional band use may be cost-effective and/or when use of such additional band may be needed in order to satisfy the respective governmental standard. Of course, the greater the number of bands used, the greater the cost of the band system. Accordingly, the user is motivated to have the system engineered so as to use as few of such longitudinal bands as possible while meeting the required safety standards.

A length of a given longitudinal band 26 extends across a given bay and is extended across the upper surface of each rafter overlain by the respective band, and is attached to the upper surfaces, or other surfaces, of the respective rafters. Where the longitudinal band 26 extends across multiple bays, the longitudinal band is secured, for restrained longitudinal movement, to the upper surfaces of those rafters which are most remote from one another. Optionally, but not necessarily, the longitudinal band may be secured to one or more intermediate rafters.

Longitudinal bands 26 are fastened to the rafters or rake channels (not shown) which correspond with the end portions of the bands by conventional attachment means such as by self-drilling screws. Longitudinal bands 26 are pulled tight between the rafters so as to, in part, and at this stage of installation, begin to define the afore-mentioned band grid, and the imaginary plane of support provided by the band grid, immediately under the intermediate purlins. Band attachment tools, known in the art, may be used in attaching the bands, either temporarily or permanently, to the rafters or rake channels, thus to instill a suitable, conventionally known, level of tension in bands 26 as the bands are being installed.

Each eave has a top flange 34, a bottom flange 36, and an upstanding web 38 extending between the top and bottom flanges, and connecting the top flange to the bottom flange. The top and bottom flanges are arranged such that the profile of the eave defines a "C"-shaped structure, perhaps best seen in FIG. 5.

While the eave profiles shown define generally perpendicular turns between the flanges 34 and 36, and upstanding web 38, actual eave profiles typically define a modest acute angle (not shown) between the bottom flange and the upstanding web and a corresponding modest obtuse angle (not shown) between the top flange and the upstanding web. Such acute and obtuse angles adapt the eave to the specific slope of the roof for which the eaves are designed, while providing that the upstanding web conform to the vertical orientation of the respective side wall of the building.

Correspondingly, each ridge has a top flange 40, a bottom flange 42, and an upstanding web 44 extending between the top and bottom flanges, and connecting the top flange to the bottom flange. The top and bottom flanges are arranged such that the profile of the ridge defines a "Z"-shaped structure, illustrated in FIG. 4.

Similarly, each intermediate purlin has a top flange 46, a bottom flange 48, and an upstanding web 50 extending between the top and bottom flanges, and connecting the top flange to the bottom flange. The top and bottom flanges are arranged such that the profile of the respective purlin defines a "Z"-shaped structure, illustrated in FIGS. 4 and 8.

Lateral bands 28 are installed after the longitudinal bands 26 are in place. Lateral bands 28 extend transverse to, typically perpendicular to, the longitudinal bands. Lateral bands 28 generally underlie and support longitudinal bands 26. Lateral bands 28 may be first attached to the respective ridge 22. Bands 28 may be attached to any suitable surface of the ridge which enables the band to pass, from the location of attachment, under and in tensioned contact with, the bottom flange of the ridge. For example, a lateral band can be attached to the bottom surface of the bottom flange of the ridge, with intervening fabric 32, and extend from there toward the eave.

As an alternative, one end of a given lateral band can extend up alongside, and be fastened to, the surface of the upstanding ridge web which faces away from the eave on the respective slope of the roof. The band passes alongside, and turns about, the edge of the bottom flange of the ridge which faces away from the respective eave, and then passes under, and in general contact with, the bottom surface of the bottom flange, again with intervening fabric, and extends from there toward the eave.

As a still further example of attachment of a lateral band to the ridge, the band can be attached to the top surface of the top flange, turn about the upper edge of the top flange which is away from the respective eave, extend from there down toward the bottom ridge flange, turn about the edge of the bottom flange and pass alongside, and in general contact with, the bottom surface of the bottom flange, and extend from there toward the eave, again with the fabric between the band and the ridge.

The lateral bands are extended, from the bottom surface of the bottom flange of the ridge toward the respective eave, passing under the longitudinal bands, and pulled tight to minimize sag in both the lateral bands and the respective overlying longitudinal bands. The so-tightened lateral bands are in general contact, again with intervening fabric, with the bottom surface of the bottom flange of the respective eave. With the so-tightened lateral bands in contact with the bottom surface of the bottom flange of the respective eave, the lateral bands are fastened to the eave so as to maintain the tension in the lateral bands, thus to lift the lateral bands toward the bottom flanges of the overlying intermediate purlins.

The number of lateral bands 28 to be used between a respective pair of next-adjacent rafters, and the spacing between the lateral bands, varies with the distance between the rafters. Typically, the lateral bands are 36 inches to 40 inches apart, optionally up to 48 inches apart in some cases.

Traditional banding stock used for bands 26 and 28 is a hot-dip zinc/aluminum alloy-coated Grade 80 structural steel, 0.023 inch thick, having longitudinal tensile yield strength of at least 93 ksi, such Grade 80 banding sometimes being referred to in the industry as "full hard". Such steel banding is typically about 1 inch wide and continuous length. Such traditional "full hard" steel banding is available from Steelscape, A BlueScope Steel Company, Kalama, Wash. as ZINCALUME® Steel Grade 80 (Class 1).

Banding used in the invention is distinguished from steel bar stock in that steel bar stock is stiff and rigid. By contrast, the banding used in the invention is thin and flexible such that the banding is typically shipped to the user in rolls. When the banding stock is cut to the e.g. specified 1-inch width, and the resulting bands are loosely draped over rafters spaced e.g. 25 feet apart, mid-sections of the bands readily drape downwardly by multiple feet from the elevations of the rafters. Further, such banding is completely incapable of supporting itself or the overlying suspension fabric until substantial tensile force, which can be manually applied using hand tools, is applied to the banding.

Certain fabrics are known in the art for use as suspension fabrics in roof insulation systems, and such fabrics may be acceptable in the fall protection systems of the invention, provided that the bands used in the band grid-work of the invention are sufficiently close together. An exemplary fabric, which the inventors have tested and found satisfactory for use with the band grid-work disclosed herein is available as Type 1070 Vapor Retarder fabric from Intertape Polymer Group, Bradenton, Fla. The Type 1070 fabric is a woven HDPE scrim having the following characteristics as specified by the fabric supplier:

Nominal thickness—9 mils (0.23 mm)
Nominal weight—4.3 oz/yd$^2$ (149 g/m$^2$)
Grab Tensile Warp—136 lb (605 N)/Weft 126 lb (559 N)
Strip Tensile—Warp 100 lb/in (877)/Weft 90 lb/in (799)
Tongue Tear—Warp 50 lb (222N)/Weft 45 lb (200 N)
Mullen Burst—245 psi (1690 kPa)
Moisture vapor transmission of 0.02 perms.

A typical bay 18 is about 25 feet wide, between pairs of next-adjacent rafters. Within a given bay, lateral bands 28 extend parallel to each other, parallel to the respective rafters which define the bay, and are generally spaced apart by about 36 inches to 40 inches, but no more than 48 inches. Thus, a desired spacing between lateral bands 28 is 36-40 inches; but up to 48 inches is accepted where the increase from 40 inches e.g. up to 48 inches can reduce the number of bands.

In the invention, the lateral bands which are closest to the opposing sides of the rafters are referred to as safety bands 28S, in part because the safety bands are the bands which are the most likely ones of the lateral bands to receive the stress of having a worker fall onto the suspension fabric used in the fall protection system. Further, the inventors have discovered that the safety bands, when stressed by a fall, absorb more of the force than when any other lateral band is stressed by a fall. The inventors contemplate that the force of a fall/drop test away from the rafters can be dispersed among at least four bands which surround the drop location; whereas by contrast, when such force is imposed close to the rafter, only 3 bands are disposed around the drop site, whereby those 3 bands, in that instance, do the work done by 4 bands at locations further away from the rafter.

The safety bands 28S are graphically delineated in FIG. 3 by dashed extensions of ch bands on the right side of the drawing.

Known prior-art-alleged fall protection systems specify that each lateral band be attached by a Tek screw to the bottom flange of each intermediate purlin, whereby a substantial fraction of the force of a worker falling, or the force of a drop test, is transferred through the respective lateral bands to the next adjacent purlin here the force is applied at the lateral band which is next-adjacent a rafter, that force is transferred by a single such lateral band.

It is known that, when a fall protection system of the prior art is tested using the government-mandated test procedure, even if the system successfully passes the test, namely catches and holds the falling object, the suspension fabric tears at the screws which fasten the fabric and bands to the purlins. Typically, the banding closest to the falling object also breaks.

As a corrective measure, some commercially available alleged fall protection systems require the use of two Tek screws, at least two inches apart, into the bottom flange of each respective eave. The purpose of the second screw is believed to be to provide additional strength to the band, to prevent the band from tearing past the screws, or tearing diagonally out the side of the band, when the object impacts the fall protection system fabric.

The determination of passing or failing the government-defined drop test is whether the falling object proceeds through the fabric, known as a test failure, or is successfully held and supported by the fabric, which is a successful, passing of the test.

The inventors herein have discovered, by their experience, by their testing, that existing commercially available alleged fall protection systems, even those using the two-screw attachment, fail the government-defined drop test when the force is applied adjacent a rafter, or anywhere the impact is not absorbed by 4 bands surrounding the point of impact. Accordingly, the invention contemplates novel ways of using the lateral bands.

As illustrated in FIGS. 5-8, the invention contemplates at least three ways of attaching a lateral band to an eave 20. As illustrated in FIGS. 9A, 9B, and 10-12, the invention contemplates a novel approach to supporting the lateral bands, and thus the band grid system, from intermediate purlins 24.

Figure 9A:
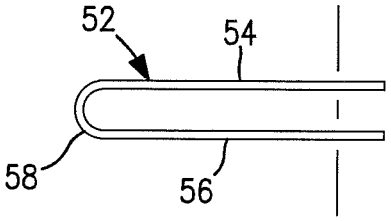
FIG. 9A shows an end view of the safety clip designed and configured to be mounted to the bottom flange of an intermediate purlin.
Figure 9B:
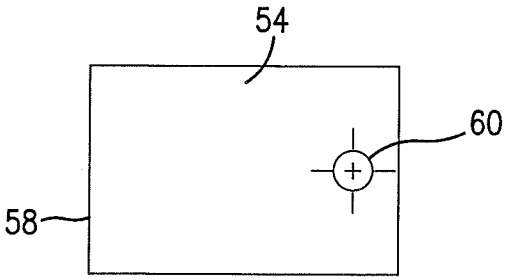
FIG. 9B shows a bottom view of a safety clip of FIG. 9A.

FIGS. 9A and 9B illustrate a safety clip 52 for use in supporting ones of the lateral bands from ones of the intermediate purlins. As illustrated in FIGS. 9A and 9B, safety clip 52 has an upper leg 54, a lower leg 56, and a bight 58 joining the upper and lower legs. Apertures 60 in upper and lower legs 54, 56, are aligned with each other, thus providing a passage which can receive a screw for fastening the safety clip to the lower flange of an overlying purlin.

Figure 10:
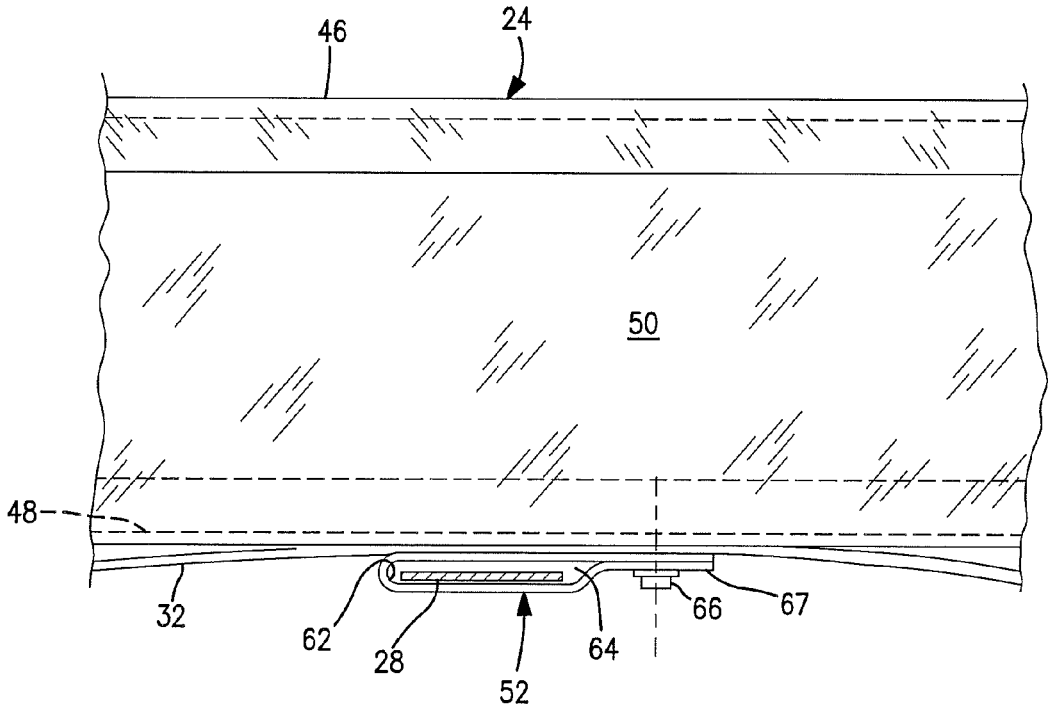
FIG. 10 shows an end view of a safety clip as in FIGS. 9A and 9B mounted to the bottom surface of the bottom flange of an intermediate purlin, through an intermediate washer, using a single Tek screw as in FIG. 8, and a safety band passing through the opening in the safety clip, and being confined against free lateral/transverse movement beyond the confines of the loop of the safety clip.
Figure 11:
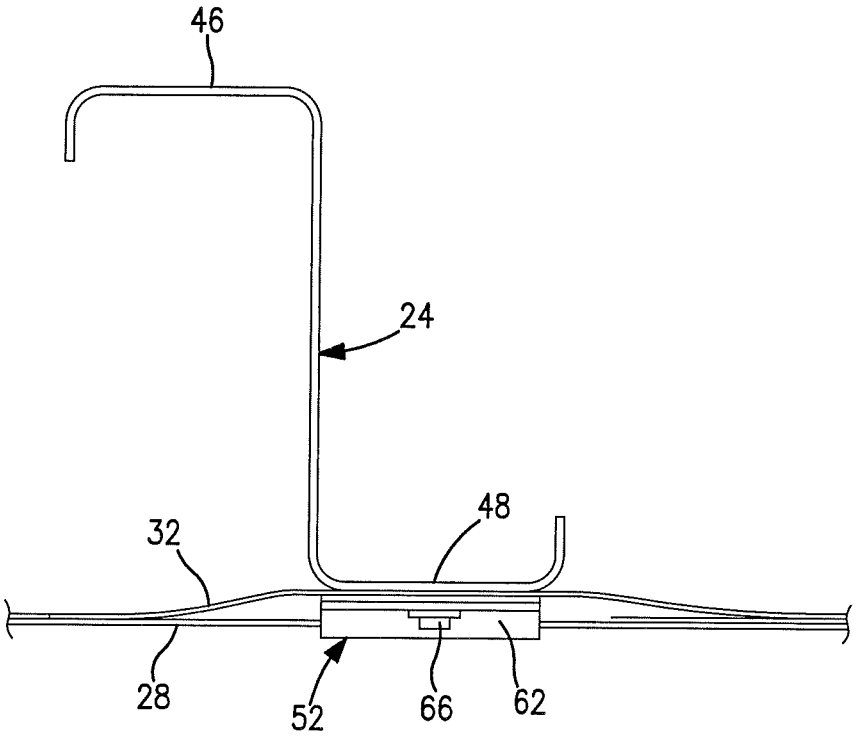
FIG. 11 shows the safety clip of FIG. 10 mounted to the bottom surface of the bottom flange of the intermediate purlin as in FIG. 10, but from an angle parallel to the bottom flange of the purlin and perpendicular to the length of the purlin.

FIG. 10 shows an end view of a safety clip 52 fastened to the bottom surface of a bottom flange 48 of one of the intermediate purlins 24. FIG. 11 shows the safety clip so fastened to the bottom surface of the bottom flange of the purlin from an end view/profile view, of the purlin. Still referring to FIGS. 10 and 11, a Tek screw 66 extends through the apertures 60 in the safety clip and thence into the bottom flange of the purlin, making the secure attachment to the purlin. As seen in FIG. 10, when the screw attaches the safety clip to the purlin, the force applied in tightening the screw closes the space between the ends of the upper and lower legs 54, 56, thus creating a flange 67 adjacent openings 60, as well as defining a closed loop 62, surrounding an opening 64 which extends through the safety clip.

The safety clip is oriented relative to the ridge and eave such that opposing ends of opening 64 are disposed, respectively, toward the corresponding ridge 22 and eave 20. Accordingly, the passage which extends through opening 64 extends in the same direction as lateral bands 28.

FIG. 10 shows one of the lateral bands 28 extending through opening 64. As illustrated in FIG. 10, safety clip 52 supports the lateral band in close proximity to the bottom of the respective purlin. The walls of loop 62, which define the opening and thus surround band 28, limit the lateral movement of band 28 relative to loop 62, such that the walls of the loop keep that portion of the band, which is facing the walls, confined to the space defined by the loop. Thus, the band cannot move laterally outside the confines of the walls of the loop.

However, safety clip 52 places no limitations on the ability of the lateral band 28 to move longitudinally with respect to the safety clip. Thus, other than incidental friction between the walls of the loop, such as at the bottom of the lateral band and the top of the lower leg of the safety clip, longitudinal movement of the lateral band relative to the safety clip is generally unhindered.

Figure 10A:
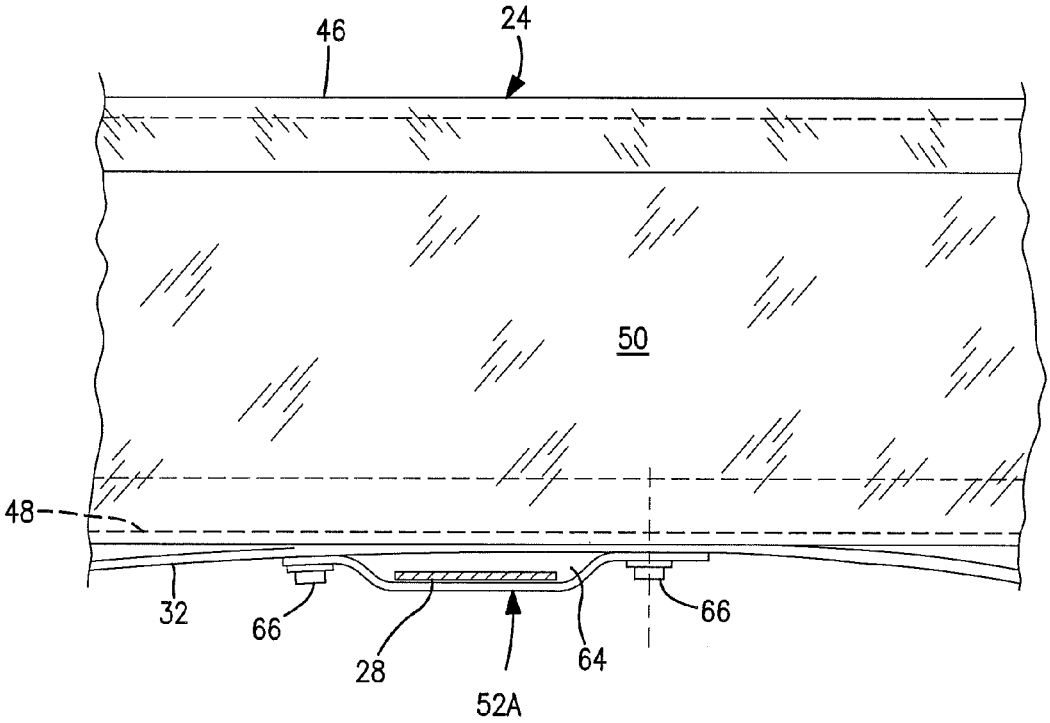
FIG. 10A shows an end view as in FIG. 10, illustrating an alternate safety clip design mounted to an intermediate purlin using first and second screws.

FIG. 10A illustrates an alternate embodiment of the safety clip, enumerated as 52*k* Safety clip 52A is made of the same material as safety clip 52, typically the same steel banding that is used for the lateral bands. But rather than folding the clip material on itself as in the embodiments of FIGS. 9A, 9B, and 10, in the embodiment illustrated in FIG. 10A, the material of safety clip 52A is formed in the shape of a flanged shallow "U". Thus, safety clip 52A, as installed, has a centrally-recessed element flanked on both sides by flanges extending from the upper ends of the recessed element. Each flange has an aperture 60, receiving a Tek screw 66 through an intervening washer, the screw extending through the washer, through the flange, through the fabric, and into and through the lower flange of the intermediate purlin. With the safety clip 52A thus anchored at flanges 67 on both ends of the safety clip, opening 64, and the corresponding passage, is defined in part by the safety clip and in part by the lower flange of the purlin.

Safety clip 52A operates very similar to safety clip 52 in that the installation of safety clip 52A limits lateral movement of band 28 while providing generally unrestricted longitudinal movement of the lateral band relative to the safety clip.

So, rather than building a fall protection system to transfer the impact force on the lateral band to the closest purlins by screwing the lateral band to the bottom flange of each purlin as in the prior art, the invention uses a longer length of banding, defined through the loop of at least one safety clip, on at least some of the lateral bands, to absorb some of the laterally-expressed energy of the impact force as well as, in some bands, to transfer a substantial portion of the laterally-expressed impact force to the ridge and eave of the roof, and/or to one or more of the intermediate purlins which are displaced from the point of impact by at least one purlin.

Figure 12:
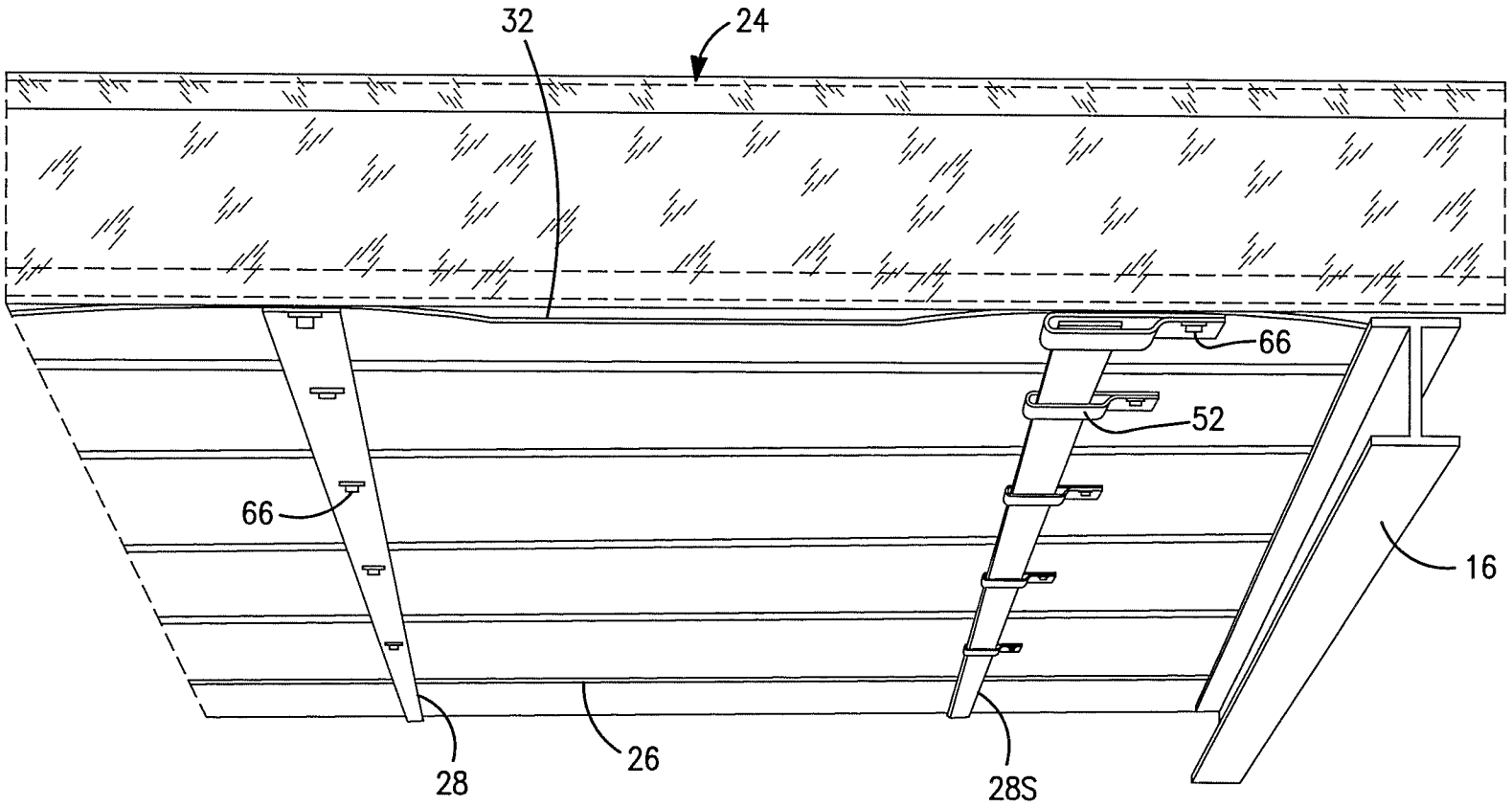
FIG. 12 shows a portion of a bay of a suspension system area which includes the safety clip viewed as in FIG. 10, and first and second next-adjacent lateral bands extending from eave to ridge, the first band being secured against longitudinal movement only at ridge and eave, the second band being secured against longitudinal movement at every purlin.

FIG. 12 illustrates a typical embodiment of the fall protection systems of the invention wherein a safety band 28S is next adjacent a rafter 16. In that embodiment, the safety band extends from ridge to eave and is secured by Tek screws 66 to the ridge and the eave. Between the ridge and the eave, the safety band passes through a safety clip 52 at each intermediate purlin between the ridge and the eave.

Thus, the safety band is secured against longitudinal movement of the band only at the ridge and at the eave. Between the ridge and the eave, the safety band is free to move longitudinally through each of the safety clips, while being restricted against lateral movement beyond the boundaries of loops 62 at the respective purlins/safety bands.

FIG. 12 also illustrates that longitudinal bands 26 are supported by lateral bands 28, in that the lateral bands underlie the longitudinal bands. Referring again to FIGS. 2 and 3, it is seen again that the longitudinal bands are secured against longitudinal movement only at rafters 16.

When a falling/dropping impact force arrives on the suspension fabric, the force received by the suspension fabric has a first directional force component and a second velocity/shock/suddenness component. The force component of the impact is resisted by, absorbed by, the deflection characteristics of the materials in the fall protection system. The velocity/shock/suddenness component of the impact addresses the rate at which the respective materials can deflect as the force of the impact is applied to the respective building elements.

Where a safety band 28S, mounted to a purlin by a safety clip 52, is one of the closest lateral bands to the point of impact, a first portion of that force is transferred, as first tensile forces, into the full length of the longitudinally-mobile portion of the respective safety band and is absorbed by tensile elongation of the safety band.

A second portion of that received force is transferred, by the safety band through the safety clips closest to the location of the impact, and thence to the purlins which are closest to the location of the impact.

A third portion of that received force is transferred, by the safety band, to the purlins, the ridge, or the eave which are next adjacent the purlins which are closest to the location of the impact, such that greater than two, typically at least four, longitudinally-extending structural members of the roof participate in dissipating substantial portions of the impact of the fall/drop. A fourth portion of that received force to the eave and ridge.

A fourth portion of that force is transferred to respective closest ones of the longitudinal bands, which transfer their received tensile forces to the respective next adjacent rafters.

A fifth remainder portion of that force is distributed about the respective affected area of the suspension fabric. While choosing to not be bound by theory, the inventors herein contemplate that the fabric absorbs both a portion of the directional component of the force of the impact and a velocity/shock/suddenness component of the force of the impact.

Turning again to the responses of the bands, the tensile forces so imposed on the longitudinal bands and the safety band are distributed along the full lengths of the respective longitudinal bands and the respective safety band, while the tensile forces imposed on the remaining ones of the lateral bands may be transferred directly to the closest ones of the intermediate purlins. Thus, the elongation properties of both the longitudinal bands and the safety band are utilized along the full lengths of such bands between their points of attachment at the ridge, the eaves, and the rafters, all of which are disposed at the edges of the respective bay.

The benefit of using the full lengths of the safety bands to absorb the impact force of the fall/drop is that more of the force is dissipated by band elongation rather than that force being retained in the fabric or transferred to the next, adjacent purlins. In addition, a portion of the force can be transferred, by the safety band, to additional ones of the purlins, and additional portions of the force can be transferred to the eave and to the ridge. Thus, the use of the safety clips to accommodate longitudinal mobility of the safety band results in dissipating more of the force of the impact in an increase number of elements of the roof structure. By increasing the number of elements of the roof structure which participate in dissipating the force of the impact, the amount of the force which must be dissipated by the fabric and by the bands is reduced. Such reduction in the amount of the force which must be dissipated by the bands and the fabric provides increased opportunity for the fabric to survive the force of the impact without catastrophic failure of the fabric which is, by definition, a failure of the fall protection system.

FIG. 12 further shows, in its typical configuration of the fall protection system of the invention, that lateral bands 28 which are not safety bands, namely which are not a lateral band next adjacent a rafter, can, and commonly are, attached to each purlin in a conventional manner, namely by screwing a Tek screw 66, with accompanying washer, through a hole in the lateral band, thence through the suspension fabric, and thence through the lower flange of the respective purlin. The suspension fabric is thus trapped between the lower flange of the purlin and the respective washer/screw combination, which tightly clamps the suspension fabric to the lower surface of the lower flange of the purlin.

Figure 13:
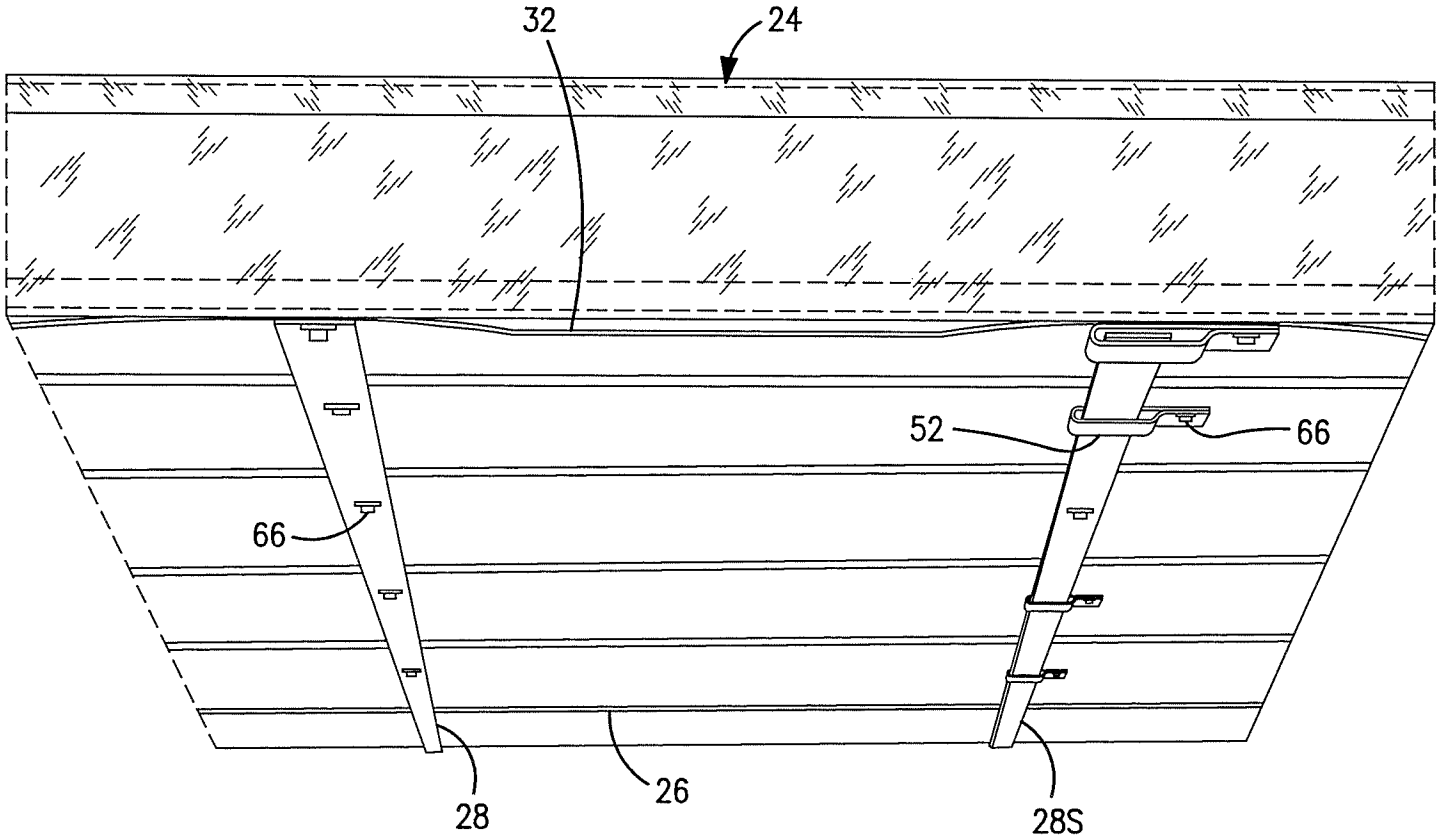
FIG. 13 shows a portion of a suspension system as in FIG. 12 wherein the first band is secured, against longitudinal movement, to one of the intermediate purlins.
Figure 14:
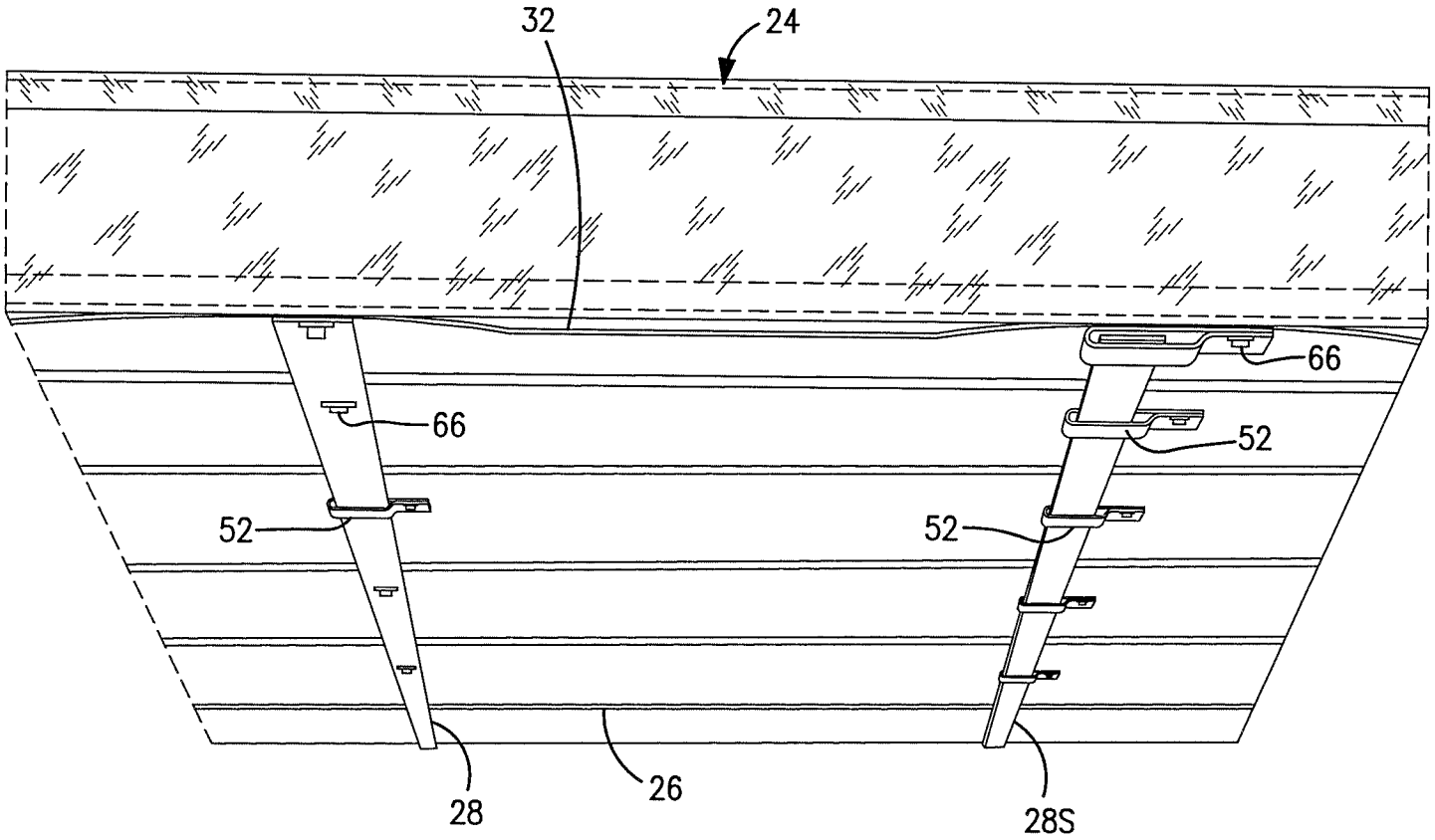
FIG. 14 shows a portion of a suspension system as in FIG. 13 wherein the second band is secured, against longitudinal movement, to fewer than all of the intermediate purlins.

FIG. 13 shows another embodiment of the fall protection system of the invention wherein the safety band is secured to the intermediate purlins using the safety clip at less than all of the purlins. FIG. 14 illustrates that some of the lateral bands which are not safety bands can be mounted to the bottom flange of a purlin using the safety clip. Thus, the designer of a given system has the flexibility to specify the safety clips for some but not all of the intersections of any one of the lateral bands. But there is both a materials cost and a labor cost attendant to use of the safety clip whereby the system designer assesses trade-offs between band strength and cost, fabric strength and cost, and the all-in, namely materials plus labor, cost of installing respective ones of the safety clips. The typical system, however, is shown in FIG. 12 where the safety bands pass through safety clips at each intermediate purlin and the remaining lateral bands are screwed directly to the purlins, through the fabric, at each intermediate purlin.

Referring again to FIGS. 5-8, the invention contemplates at least three ways of attaching a lateral band, and the suspension fabric, to an eave 20. Starting with FIG. 5, the invention contemplates that a lateral band 28, whether or not a safety band 28S, underlies the suspension fabric 32, and traps the fabric between the lateral band and the bottom flange of the overlying eave. As a first method of attachment, in some embodiments, the lateral band can be attached to eave 20 by one or more, e.g. self-drilling, Tek screws 66 extending through respective one or more holes spaced longitudinally along the length of the respective lateral band, through a cooperating washer 68, and driven thence into and through the bottom flange 36 of the eave. In typical uses, a single Tek screw is sufficient to hold the lateral band to the bottom flange of the eave.

Figure 5:
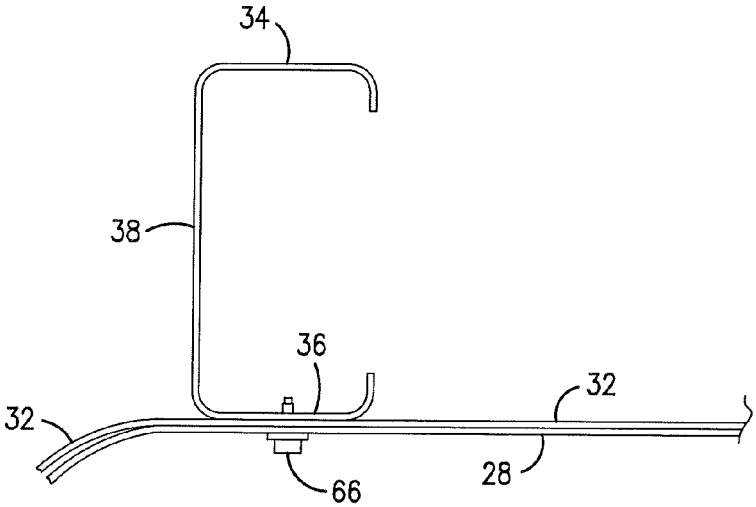
FIG. 5 is an edge view showing a lateral band fastened, attached to the bottom flange of the eave.
Figure 5A:
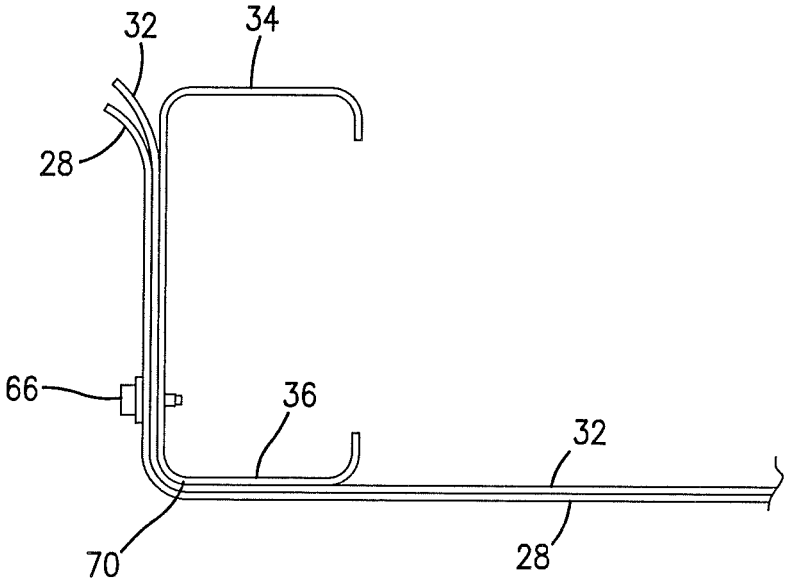
FIG. 5A is an edge view showing a lateral band fastened, attached to the upstanding web of the eave.

In a second set of embodiments, illustrated in FIG. 5A, the lateral band, whether or not a safety band 28S, underlies the suspension fabric 32 and traps the fabric between the respective lateral band and the bottom flange 36 of the overlying eave. In this second set of embodiments, the lateral band extends past the remote edge 70 of the bottom flange of the eave which is remote from the corresponding ridge 22, turns an e.g. 90 degree corner about that remote edge 70 of the bottom flange and extends upwardly from the bottom flange alongside the upstanding web 38 of the eave. One or more Tek screws 66 extend through web 38 of the eave, terminating the band attachment at web 38. In typical uses, a single Tek screw is sufficient to hold the lateral band to the web of the eave.

Figure 6:
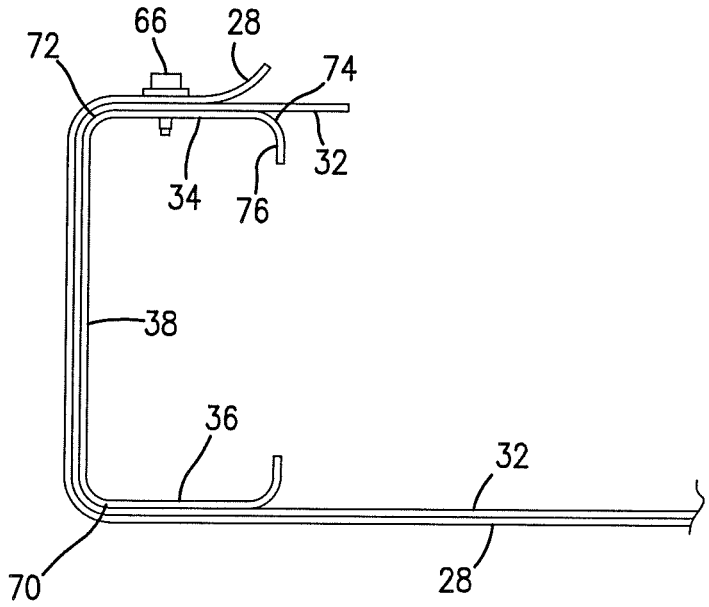
FIG. 6 is an edge view as in FIG. 5 wherein the lateral band turns a first corner about the remote edge of the bottom flange of the eave, extends up the web, turns a second corner about the remote edge of the top flange of the eave, and is fastened, attached to the top flange of the eave.

In a third set of embodiments, illustrated in FIG. 6, the lateral band, whether or not a safety band 28S, underlies the suspension fabric 32 and traps the fabric between the respective lateral band and the bottom flange 36 of the overlying eave. In this third set of embodiments, the lateral band extends past the remote edge 70 of the bottom flange of the eave which is remote from the corresponding ridge 22, turns a first, e.g. 90 degree, corner about that remote edge 70 of the bottom flange and extends upwardly from the bottom flange alongside the upstanding web 38 of the eave to a remote edge 72 of top flange 34 of the eave, and turns a second e.g. 90 degree corner about remote edge 72, thence to extend toward the respective ridge 22. One or more Tek screws 66 extend through top flange 34 of the eave, terminating the band attachment at top flange 34 of the eave, in typical uses, single Tek screw is sufficient to hold the lateral band to the top flange of the eave.

Figure 7:
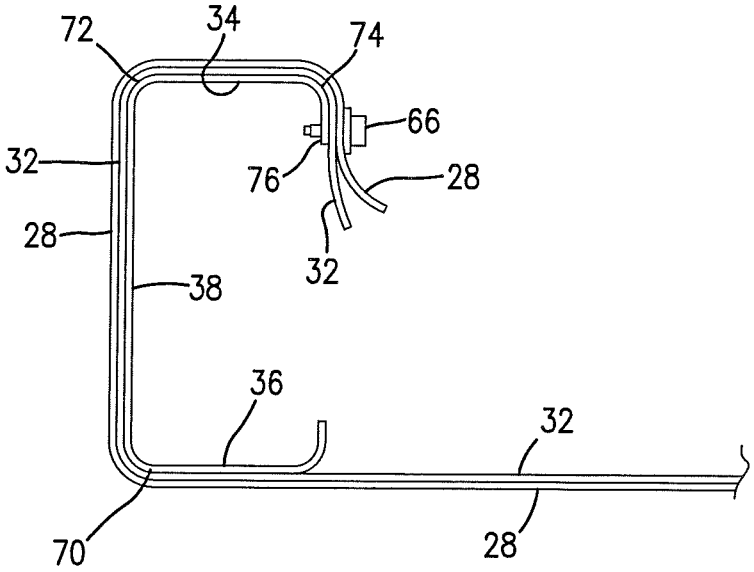
FIG. 7 is an edge view as in FIG. 6 wherein the lateral band turns a third corner about the distal edge of the top flange of the eave and is attached to the top flange return of the eave.

In a fourth set of embodiments, illustrated in FIG. 7, the lateral band, whether or not a safety band 28S, underlies the suspension fabric 32 and traps the fabric between the respective lateral band and the bottom flange 36 of the overlying eave. In this third set of embodiments, the lateral band extends past the remote edge 70 of the bottom flange of the eave which is remote from the corresponding ridge 22, turns a first, e.g. 90 degree, corner about that remote edge 70 of the bottom flange and extends upwardly from the bottom flange alongside the upstanding web 38 of the eave to a remote edge 72 of top flange 34 of the eave, turns a second e.g. 90 degree corner about remote edge 72, thence to extend the lateral band toward the respective ridge 22, and turns a third e.g. 90 degree corner about the distal edge 74 of the top flange, and overlies a top flange return 76 of the eave. One or more Tek screws 66 extend through the top flange return 76 of the eave, terminating the band attachment at top flange return 76. In typical uses, a single Tek screw is sufficient to hold the lateral band to the top flange return.

The common feature of the attachments in FIGS. 5A, 6 and 7 is that lateral band 28 turns about at least one corner of the eave before being attached by the Tek screw to the eave. Such turning of the one or more corners before the attachment of the band to the eave operates to transfer some of the tensile force from the band to the eave at a location between the one or more screws 66 and the distal edge of the bottom flange of the eave, thereby correspondingly reducing the tensile force on the band at the screw, with corresponding reduction in the interfacial force between the one or more screws 66 and the band. Reduced force between screws and band means reduced prospect for failure of the band at the one or more screws.

In addition, referring now to FIGS. 5A, 6, and 7, turning the band about a corner of the eave before reaching the screw means that the full width of the band can be used to apply the force to the eave. Namely, if the force is applied directly through a screw as in FIG. 5, a fraction of the width of the band, and thus some strength of the band, is lost in removal of band material at the screw aperture 60. Restated, the force which is transferred to the eave ahead of the screw aperture is transferred by the full width of the band, reducing the likelihood that the band will break at the hole in the process of transferring the force to the eave.

As an alternative to wrapping the fabric about the eave with the lateral band, the fabric can extend inside the eave instead of outside the eave. A leading edge of the fabric enters the eave above bottom flange 36, passes across the top of the bottom flange to web 38, passes along the inside surface of web 38 and up to upper flange 34 and thence toward the ridge to the opening which faces the ridge. By traversing such path inside the cavity defined inside the eave, the fabric can substantially encase the edge of any insulation which is to be ins lied on top of the fabric in the space between the eave and the next-adjacent purlin.

Purlins 24, eave 20, and ridge 22 extend a few inches beyond the respective rafter. A rake channel defining a "C-shaped" cross-section, not shown, is commonly mounted over the ends of the purlins, the eave, and the ridge, at the end of the building. The invention also contemplates that, instead of the longitudinal bands being fastened to the top flange of the corresponding rafter, the longitudinal bands 26 can pass over the top of the upper flange of the rafter, under the lower flange of the rake channel, and wrap about at least one corner of the bottom flange of the rake channel, optionally about the top flange of the rake channel, as illustrated in FIGS. 5A and 6; and such longitudinal band being fastened to the rake channel at the respective web or top flange of the rake channel, similar to the fastening shown for the eave in FIGS. 5A and 6.

At the eave, the embodiments of FIG. 5 have the highest probability of failure, though the embodiments of FIG. 5 are satisfactory for some uses. The embodiments of FIG. 5A provide a first level of reduction in stress on the band at screw 66, first by transferring a portion of the band stress to the eave at the remote corner of the lower eave flange, second by transferring some of the stress before that stress reaches the screw aperture.

The embodiments of FIG. 6 provide a second enhanced level of reduction in stress on the band at screw 66, by turning the second corner before the stress reaches the screw aperture.

The embodiments of FIG. 7 provide a third, further enhanced, level of reduction in stress on the band at screw 66. Thus, all else being equal, each turn of the band about any corner enhances the level of stress reduction on the band and enhances the reduction in stress which ultimately reaches the screw aperture 60, thus increasing the prospect that the system will successfully catch and hold a falling object.

Thus, referring to the combination of FIGS. 5, 5A, and 6-14, a full implementation of the invention contemplates suspending some or all of the safety bands 28S from the purlins using safety clips 52 as illustrated in FIGS. 10-14 and turning some or all of the lateral bands about one or more of the edges of the eave flanges in the process of terminating the respective lateral bands, as illustrated in FIGS. 5A, 6, and 7.

Thus, in a given embodiment, the safety bands are suspended from the intermediate purlins by safety clips, and the ends of the safety bands turn at least one corner about the remote edge of the lower flange of the eave before being terminated at one or more screws 66; and the remaining lateral bands (non-safety bands) are fastened to the intermediate purlins, either directly through the suspension fabric through, a washer, or fastened to some or all of the intermediate purlins using safety clips. The remaining lateral bands (non-safety bands) may be fastened to each of the intermediate purlins directly through the fabric to the lower flange of the purlin using a screw.

Method

Installation of a fall protection system of the invention begins after the columns, rafters, ridges, eaves, and intermediate purlins are in place about at least a given bay. Typically, installation of the fall protection system begins after erection/emplacement of all of the columns, rafters, ridges, eaves, and purlins.

Installation of the fall protection system begins by installing longitudinal bands 26. A given longitudinal band is installed by unwinding band material from a roll and extending the band material over the tops of the respective rafters and across a given hay or bays. At least one longitudinal band is extended, between each next-adjacent pair of purlins to at least the next rafter, and is cut to length. The longitudinal bands are manually stretched tight with hand tools, and the so-tightened bands are fastened to the respective rafters with Tek screws. As illustrated in the drawings, the longitudinal bands typically extend perpendicular to the rafters. The so-partially-installed, tightened, longitudinal bands extend from rafter to rafter at generally the height of the tops of the rafters, but some nominal amount of sag of the longitudinal bands exists between the rafters at this stage of installation.

Typically, the purlins are spaced no more than 5 feet apart. In this invention, typically a single band is installed between each pair of next-adjacent purlins so long as the purlin spacing is no more than the typical maximum of 5 feet. Where the purlin spacing approaches, or exceeds, the typical 5-feet maximum, an additional longitudinal band 26 may be used in one or more of the spaces between the purlins.

Once the longitudinal bands 26 have been emplaced and tightened, banding for lateral bands 28 is unrolled under the longitudinal bands, and one end of the banding is secured to the respective ridge or purlin, or to an opposing eave. The lateral banding material is extended to the eave and then tightened sufficiently to raise both the lateral band and the overlying longitudinal bands into close proximity with the intermediate purlins. This process is repeated along the width of the bay, e.g. between the rafters, until the desired number of lateral bands has been emplaced across the width of the bay.

With the band grid system thus temporarily in place, a zigzag-folded roll of the suspension fabric is elevated to the height of the rafters, typically adjacent a rafter at an end of the building or bay. The fabric is then unrolled on top of the band grid in one of the spaces between next-adjacent ones of the purlins such that one end of the fabric faces the eave and the opposing end of the fabric faces the ridge. The ends of the fabric are then pulled, individually, toward the eave and the ridge, working the leading ends of the fabric under the intervening purlins and above the band grid. The initial phase of the process of so-extending the fabric is illustrated in FIG. 3.

Once the fabric has been generally extended the full length and width of the bay over which the fabric is to be suspended, over the band grid and under the intermediate purlins, the lateral bands are then attached to the intermediate purlins, beginning at the ridge and working toward the eave. The method of such attachment at each intersection of band and purlin is determined by the fall protection system which has been designed for, specified for, that particular building. In a typical design, the safety bands 28S are attached to each purlin using safety clips 52.

Figure 8:
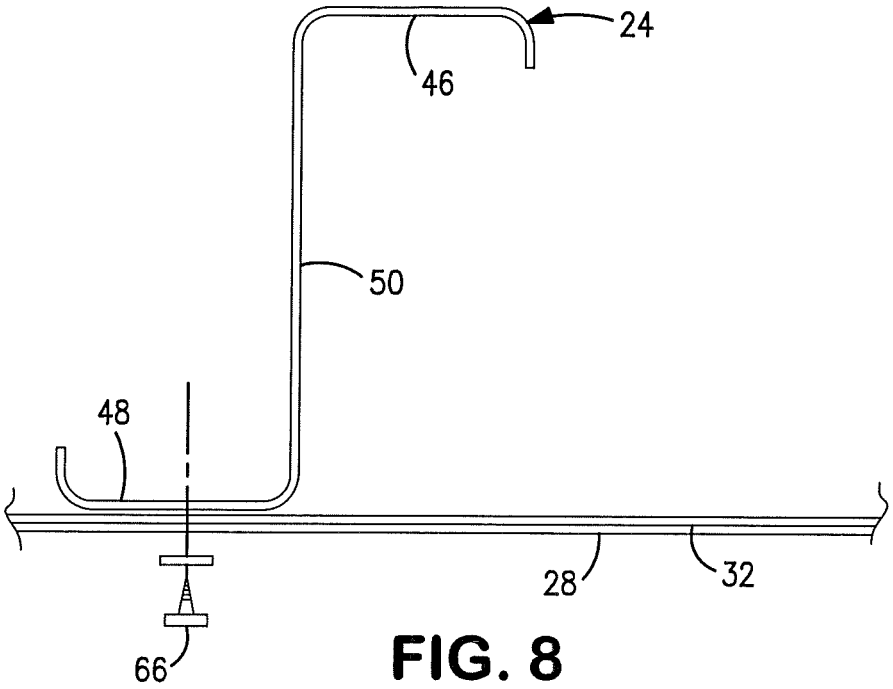
FIG. 8 shows a cross-section of an intermediate purlin, and a Tek screw, with washer, positioned to extend the screw through the fabric and into the purlin bottom flange.

For example, a safety clip such as that shown in FIGS. 7 and 8 is slipped transversely across the safety band such that an edge of the safety band is located proximate bight 58. The safety clip, with resident safety band proximate bight, is positioned against the lower surface of the suspension fabric with apertures 60 aligned with the lower flange of the corresponding intermediate purlin. A self-drilling Tek screw 66 is then driven through apertures 60, through fabric 32, and into the lower flange of the purlin. As the screw is driven tight against the bottom surface of the fabric, driving the fabric against the bottom surface of the lower flange of the purlin, the space between legs 54 and 56, of clip 52, closes, thus defining the two-layer flange 67 illustrated in e.g. FIGS. 9 and 11. Screws 66 are then driven through the remaining lateral bands 28 at each purlin, fastening the lateral bands directly to the purlins as illustrated in FIG. 13.

Once the attachments to the intermediate purlins have been completed, the temporary attachments of the bands to the eave are released, and the fabric is worked up alongside the eave, such as alongside web 38, top flange 34, and/or top flange return 76, with the fabric thus between the eave and the respective lateral bands. With the fabric thus in place, each band is again stretched against the eave and permanently fastened to the eave at the respective location on the eave, according to the embodiment being implemented, whether the embodiment of FIG. 5, the embodiment of FIG. 5A, the embodiment of FIG. 6, or the embodiment of FIG. 7.

Sides of the fabric are then cut around the purlins at each rafter, as known in the art, and edges of the fabric are secured to the top surfaces of the rafter such as by adhesive, also as known in the art.

With both the longitudinal and lateral bands so secured to the roof structure; with the fabric so secured to the ridge and eave by the lateral bands and secured to the rafters by e.g. adhesive, installation of the fall protection system of the invention is thus complete and ready to protect workers who subsequently install other elements of the building while working at the roof elevation; such elements as the roof insulation and the roof panels.

Suspension fabric 32, which in the preferred embodiment consists of a vapor barrier material, is trimmed to size before installation. The suspension fabric is installed one bay 18 at a time and, in the case of large buildings or buildings with high gables, fabric 32 for each half of the bay may be divided at ridge 22 and may be installed separately.

The suspension fabric has been cut, prior to installation, to a size having a dimension a few inches longer than the dimensions of the bay to be overlaid, and is Z-folded for easy spreading above the band grid. For this purpose a zigzag type fold, as shown in FIG. 3, is easiest to work with, although other rolling or folding arrangements can also be used and are within the scope of the invention.

The fall protection systems of the invention are designed to be of sufficient strength to catch and support a man's weight, generally between 250 and 400 pounds. The system is tested by dropping a 400 lb. weight with the center of gravity of the weight, before the weight is dropped, being 42 inches above a worker's walking height, thus 42 inches plus the height of the purlins, namely about 50.5 inches above the fabric. To pass the test, the system must stop the falling weight at any point in the bay which is so protected. In one test specified by OSHA, 400 lb. of washed gravel or sand is placed into a reinforced bag that can tolerate being dropped repeatedly. The test bag is 30 inches in diameter, plus or minus 2 inches. The 400 pound bag is hoisted above the fall protection system to a height of 42 inches above the plane of the intermediate purlins, measuring from the center of the so-filled bag. A cord supporting the weight of the bag is then released, allowing the weight to free fall in one concentrated load. The weight can be dropped onto any part of the fall protection system to test different areas.

Although the invention has been described with respect to various embodiments, it should be realized this invention is also capable of a wide variety of further and other embodiments within the spirit and scope of the appended claims.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

Having thus described the invention, what is claimed is:

1. A fall protection system in a building roof structure of a building, for protecting workers on such roof structure from falling through such roof structure, such building roof structure including structural roof elements including at least first and second rafters, a space between said first and second rafters defining a first distance between said first and second rafters, each said rafter having a top, and opposing first and second ends, said roof structure further comprising an eave, having a length, and extending between the first ends of said first and second rafters, a ridge, having a length, and extending between the second ends of said first and second rafters, and a second distance between said eave and said ridge, said eave and said ridge being disposed on, and extending transverse to, the tops of said first and second rafters, and a plurality of intermediate purlins extending between said first and second rafters and spaced from each other between said eave and said ridge, said intermediate purlins being disposed on, and extending transverse to, the tops of said first and second rafters, said fall protection system comprising:

(a) a first set of support bands extending from said first rafter to said second rafter and being connected to said building, said first set of support bands being spaced along the lengths of said first and second rafters;

(b) a second set of support bands extending from said eave toward said ridge and under said intermediate purlins, said bands of said second set of support bands having first and second end portions and being spaced along the lengths of said eave and said ridge; and (c) a suspension fabric attached to said building structural roof elements, said suspension fabric underlying said intermediate purlins and overlying said first and second sets of support bands, said first and second sets of support bands supporting said suspension fabric, a first band of said second set of support bands having a generally horizontally-extending length, a generally horizontally-extending width, and a generally vertically-extending thickness, a safety clip being attached to one of said intermediate purlins, said safety clip, either alone or in combination with said intermediate purlin, defining an opening at or adjacent said purlin, said first band extending through such opening, and wherein sides of such opening restrict said first band at said one intermediate purlin relative to lateral movement of said first band while accommodating generally unrestricted longitudinal movement of said first band through such opening.

2. A fall protection system as in claim 1 wherein said first band is attached to said building roof structure only at said first and second end portions.

3. A fall protection system as in claim 1, a said intermediate purlin having a top flange, a bottom flange, and a web extending between said top flange and said bottom flange, and wherein said first band is held proximate said bottom flange of the respective said purlin.

4. A fall protection system as in claim 1 wherein said second set of support bands supports said first set of support bands.

5. A fall protection system as in claim 1, said eave having a top flange having a first remote edge remote from said ridge and a first distal edge relatively closer to said ridge, a bottom flange having a second remote edge remote from said ridge and a second distal edge relatively closer to said ridge, and a web extending between said top flange and said bottom flange, and wherein said first band extends under said bottom flange of said eave, and said first band turns a first corner about the second remote edge of said bottom flange and extends upwardly from said bottom flange alongside said web, said first end portion of said first band being attached to said eave between the first corner and a remote end of said first band.

6. A fall protection system as in claim 1, said eave having a top flange having a first remote edge remote from said ridge and a first distal edge relatively closer to said ridge, a bottom flange having a second remote edge remote from said ridge and a second distal edge relatively closer to said ridge, and a web extending between said top flange and said bottom flange, and wherein said first band extends under said bottom flange of said eave, and said first band turns a first corner about the second remote edge of said bottom flange and extends upwardly from said bottom flange alongside said web to the top flange, turns a second corner about the first remote edge of said top flange, and extends toward said ridge, said first end portion of said first band being attached to a said roof structural element between the second corner and a remote end of said first band.

7. A fall protection system as in claim 6 wherein said eave further comprises a top flange return extending down from the distal edge of said top flange, and wherein said first band turns a third corner about the first distal edge of said top flange, and is attached to said eave between the third corner and the remote end of said first band.

8. A fall protection system as in claim 1, any attachment of said first band to said building, for restraint of longitudinal movement of said first band, being spaced from any other such attachment of said first band to the building, including from any attachment at the first and second end portions by at least 10 feet.

9. A fall protection system as in claim 1, any attachment of said first band to said building, for restraint of longitudinal movement of said first band, being spaced from any other such attachment of said first band to the building, including from any attachment at the first and second end portions by at least 20 feet.

10. A fall protection system in a building roof structure of a building, for protecting workers on such roof structure from falling through such roof structure, such building roof structure including structural roof elements including at least first and second rafters, a space between said first and second rafters defining a first distance between said first and second rafters, each said rafter having a top, and opposing first and second ends, said roof structure further comprising an eave, having a length, and extending between the first ends of said first and second rafters, a ridge, having a length, and extending between the second ends of said first and second rafters, and a second distance between said eave and said ridge, said eave and said ridge being disposed on, and extending transverse to, the tops of said first and second rafters, and a plurality of intermediate purlins extending between said first and second rafters and spaced from each other between said eave and said ridge, said intermediate purlins being disposed on, and extending transverse to, the tops of said first and second rafters, said fall protection system comprising:

(a) a first set of support bands extending from said first rafter to said second rafter and being connected to said building, said first set of support bands being spaced along the lengths of said first and second rafters;

(b) a second set of support bands extending from said eave toward said ridge and under said intermediate purlins, said bands of said second set of support bands having first and second end portions and being spaced along the lengths of said eave and said ridge; and (c) a suspension fabric attached to said building structural roof elements, said suspension fabric underlying said intermediate purlins and overlying said first and second sets of support bands, said first and second sets of support bands supporting said suspension fabric, said eave having a top flange having a first remote edge remote from said ridge and a first distal edge relatively closer to said ridge, a bottom flange having a second remote edge remote from said ridge and a second distal edge relatively closer to said ridge, and a web extending between said top flange and said bottom flange, and wherein said first band extends under said bottom flange of said eave, and said first band turns a first corner about the second remote edge of said bottom flange and extends upwardly from said bottom flange alongside said web, the first end portion of said first band being attached to a said roof structural element between the first corner and a remote end of said first band, and wherein the turning of said first band about the first corner transfers a substantial portion of any tensile force, imposed on said first band between said eave and said ridge, directly to said eave.

11. A fall protection system as in claim 10 wherein said first band turns a second corner about the first remote edge of said top flange, and extends, as the first end portion of said first band, toward said ridge, the first end portion of said first band being attached to said roof structural element between the second corner and the remote end of said first band, and wherein the turning of said first band about the second corner transfers an additional portion of any tensile force, imposed on said first band between said eave and said ridge, directly to said eave.

12. A fall protection system as in claim 11 wherein said eave further comprises a top flange return extending down from the distal edge of said top flange, and wherein said first band turns a third corner at the first distal edge of said top flange, extends downwardly along the top flange return, and is attached to said roof structural element between the third corner and such remote end of said first band.

13. A fall protection system as in claim 10, any attachment of said first band to said building, for restraint of longitudinal movement of said first band, being spaced from any other such attachment of said first band to the building, including from any attachment at the first and second end portions by at least 10 feet.

14. A fall protection system as in claim 10, any attachment of said first band to said building, for restraint of longitudinal movement of said first band, being spaced from any other such attachment of said first band to the building, including from any attachment at the first and second end portions by at least 20 feet.

15. A fall protection system as in claim 10 wherein said first band is attached to said building only at said first and second end portions.

16. A fall protection system as in claim 10, said intermediate purlins having top flanges and bottom flanges, and webs extending between said top flanges and said bottom flanges, and wherein said second set of support bands supports said first set of support bands and wherein, at locations where a support band of the second set supports a support band of the first set, the band of the second set holds the band of the first set at an elevation which approximates an elevation of the bottom flange of an adjacent said intermediate purlin.

17. In a roof structure of a building, building structural roof elements including at least first and second rafters, a space between the first and second rafters defining a first distance between the first and second rafters, each rafter having an upper surface, and opposing first and second ends, the roof structure further comprising an eave, having a first length, and extending between the first ends of the first and second rafters, the building structural roof elements further comprising a ridge, the eave having a top flange having a first remote edge relatively remote from the ridge and a first distal edge relatively closer to the ridge, a bottom flange having a second remote edge relatively remote from the ridge and a second distal edge relatively closer to the ridge, and a web extending between the top flange and the bottom flange, the ridge, having a second length, and extending between the second ends of the first and second rafters, and a second distance between the eave and the ridge, the eave and the ridge being disposed on, and extending transverse to the tops of the first and second rafters, a plurality of intermediate purlins extending between the first and second rafters and spaced from each other between the eave and the ridge, the intermediate purlins being disposed on, and extending transverse to, the tops of the first and second rafters, the building roof structure including a fall protection system for protecting workers on such roof structure from falling through such roof structure, the fall protection system comprising a first set of support bands extending from the first rafter to the second rafter, the first set of support bands being connected to the building, the first set of support bands being spaced along the lengths of the first and second rafters, a second set of support bands extending from the eave toward the ridge and under the intermediate purlins, and a suspension fabric overlying the first and second sets of support bands such that the suspension fabric is supported by the first and second sets of support bands, a method of mounting an end portion of a first band, of the second set of bands, to the eave, the method comprising extending the first band under the bottom flange of the eave, turning the first band about a first corner at the second remote edge of the bottom flange and directing the first band upwardly from the bottom flange alongside the web, and fastening the first end portion of the first band to a such roof structural element between the first corner and a remote end of the first band, the turning of the first band about the first corner transferring a substantial portion of any tensile force, imposed on the first band between the eave and the ridge, directly to the eave.

18. A method as in claim 17, further comprising turning the first band about a second corner at the first remote edge of the top flange so as to direct the first end portion of the first band toward the ridge, and fastening the first end portion of the first band to such roof structural element between the second corner and a remote end of the first band, the turning of the first band about the second corner transferring an additional portion of any tensile force, imposed on the first band between the eave and the ridge, directly to the eave.

19. A method as in claim 18, the eave further comprising a top flange return extending down from the distal edge of the top flange, the method further comprising turning the first band about a third corner at the first distal edge of the top flange so as to direct the first end portion of the first band downwardly from the third corner along the top flange return, and fastening the first end portion of the first band to such roof structural element between the third corner and the remote end of the first band.

20. A method as in claim 17, further comprising attaching the first band to the building, for restraint of longitudinal movement of the first band, such that any such attachment of the first band to the building is spaced from any other such attachment of the first band to the building, including from any attachment of the first band at the first and second end portions, by at least 10 feet.

21. A method as in claim 17, further comprising attaching the first band to the building for restraint of longitudinal movement of the first band, such that any such attachment of the first band to the building is spaced from any other such attachment of the first band to the building, including from any attachment of the first band at the first and second end portions, by at least 20 feet.

22. A method as in claim 17, the first band having first and second end portions, the method further comprising attaching the first band to the building only at the first and second end portions.

23. A method as in claim 17, a such purlin having a top flange, a bottom flange, and a web extending between the top flange and the bottom flange, the first band, when in a generally horizontally-extending orientation, having a generally horizontally-extending length, a generally horizontally-extending width, and a generally vertically-extending thickness, the method further comprising (i) attaching a safety clip to one of the intermediate purlins, the safety clip, either alone or in combination with the intermediate purlin, defining an opening at or adjacent the intermediate purlin, and extending through the safety clip, and (ii) extending the first band through the opening such that the band is confined, by walls of the opening, proximate the respective intermediate purlin, against lateral movement, the safety clip accommodating unrestricted longitudinal movement of the first band through the opening.

24. In a roof structure of a building, building structural roof elements including at least first and second rafters, a space between the first and second rafters defining a first distance between the first and second rafters, each rafter having an upper surface, and opposing first and second ends, the roof structure further comprising an eave, having a first length, and extending between the first ends of the first and second rafters, the building structural roof elements further comprising a ridge, having a second length, and extending between the second ends of the first and second rafters, and a second distance between the eave and the ridge, the eave and the ridge being disposed on, and extending transverse to, the tops of the first and second rafters, a plurality of intermediate purlins extending between the first and second rafters and spaced from each other between the eave and the ridge, the intermediate purlins being disposed on, and extending transverse to, the tops of the first and second rafters, the building roof structure including a fall protection system for protecting workers on-such roof structure from falling through such roof structure, the fall protection system comprising a first set of support bands extending from the first rafter to the second rafter, the first set of support bands being connected to the building, the first set of support bands being spaced along the lengths of the first and second rafters, a second set of support bands extending from the eave toward the ridge and under the intermediate purlins, the second set of support bands being spaced along the lengths of the eave and the ridge and underlying the first set of support bands, and a suspension fabric overlying the first and second sets of support bands and underlying the intermediate purlins such that the suspension fabric is supported by the first and second sets of support bands, a given one of the intermediate purlins having a top flange, a bottom flange, and a web extending between the top flange and the bottom flange, a first band of the second set of support bands, when in a generally horizontally-extending orientation, having a generally horizontally-extending length, a generally horizontally-extending width, and a generally vertically-extending thickness, a method of mounting the first band to a given one of the intermediate purlins, the method comprising (a) attaching a safety clip to one of the intermediate purlins, the safety clip, either alone or in combination with the intermediate purlin, defining an opening at or proximate the intermediate purlin, and extending through the safety clip; and (b) extending the first band through the opening such that the first band is confined, by walls of the opening, proximate the respective intermediate purlin, against lateral movement of the safety clip, the safety clip accommodating generally unrestricted longitudinal movement of the first band through the opening.

25. A method as in claim 24, the eave having a top flange having a first remote edge relatively remote from the ridge and a first distal edge relatively closer to the ridge, a bottom flange having a second remote edge relatively remote from the ridge and a second distal edge relatively closer to the ridge, and a web extending between the top flange and the bottom flange, the method further comprising mounting an end portion of the first band, of the second set of bands, to the eave, including extending the first band under the bottom flange of the eave, turning the first band about a first corner at the second remote edge of the bottom flange and directing the first band upwardly from the bottom flange alongside the web, and attaching the first end portion of the first band to a such roof structural element between the first corner and a remote end of the first band, the turning of the first band about the first corner transferring a substantial portion of any tensile force, imposed on the first band between the eave and the ridge, directly to the eave.

26. A method as in claim 25, further comprising turning the first band about a second corner at the first remote edge of the top flange so as to direct the first end portion of the first band toward the ridge, and fastening the first end portion of the first band to such roof structural element between the second corner and a remote end of the first band, the turning of the first band about the second corner transferring an additional portion of any tensile force, imposed on the first band between the eave and the ridge, directly to the eave.

27. A method as in claim 26, the eave further comprising a top flange return extending down from the distal edge of the top flange, the method further comprising turning the first band about a third corner at the first distal edge of the top flange so as to direct the first end portion of the first band downwardly from the third corner, and fastening the first end portion of the first band to such roof structural element between the third corner and the remote end of the first band.

28. A method as in claim 24, further comprising attaching the first band to the building, for restraint of longitudinal movement of the first band, such that any such attachment is spaced from any other such attachment of the first band to the building, including being spaced from any attachment of the first band at the first and second end portions, by at least 10 feet.

29. A method as in claim 24, further comprising attaching the first band to the building, for restraint of longitudinal movement of the first band, such that any such attachment is spaced from any other such attachment of the first band to the building, including being spaced from any attachment of the first band at the first and second end portions, by at least 20 feet.

* * * * *